US010474096B2

(12) United States Patent
Hirayama et al.

(10) Patent No.: US 10,474,096 B2
(45) Date of Patent: Nov. 12, 2019

(54) CARTRIDGE AND IMAGE FORMING APPARATUS

(71) Applicant: CANON KABUSHIKI KAISHA, Tokyo (JP)

(72) Inventors: Akinobu Hirayama, Susono (JP); Takahito Ueno, Mishima (JP); Toshiaki Takeuchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/991,086

(22) Filed: May 29, 2018

(65) Prior Publication Data

US 2018/0348700 A1 Dec. 6, 2018

(30) Foreign Application Priority Data

May 31, 2017 (JP) ..... 2017-107458

(51) Int. Cl.
*G03G 21/18* (2006.01)
*G03G 15/08* (2006.01)
(Continued)

(52) U.S. Cl.
CPC ..... *G03G 21/1853* (2013.01); *G03G 15/0886* (2013.01); *G03G 15/0898* (2013.01);
(Continued)

(58) Field of Classification Search
CPC ..... G03G 21/1853
(Continued)

(56) References Cited

U.S. PATENT DOCUMENTS 5,671,461 A * 9/1997 Ishii ..... G03G 15/0875 222/DIG. 1
6,385,416 B1 5/2002 Horikawa et al.
(Continued)

FOREIGN PATENT DOCUMENTS

CA 2 977 921 A1 9/2016
CA 2977921 A1 * 9/2016 ..... G03G 21/10
(Continued)

OTHER PUBLICATIONS

Eto. Translation of JP-2010096827. Pub. Apr. 2010. Translated Jan. 2019.*
(Continued)

*Primary Examiner* — Walter L Lindsay, Jr.
*Assistant Examiner* — Philipmarcus T Fadul
(74) *Attorney, Agent, or Firm* — Venable LLP

(57) ABSTRACT

A cartridge detachably mountable to a main assembly of an image forming apparatus includes a photosensitive drum; a discharging path for permitting movement of a developer removed from the drum, the discharging path including a developer discharge opening and a movable portion through which the developer is movable and which is movable between a retracted position in an upstream side with respect to a developer moving direction through the discharge opening and a advanced position in a downstream side with respect to the developer moving direction; and a sealing portion for closing the discharging path by contacting the movable portion at a position different from that of the discharge opening.

43 Claims, 23 Drawing Sheets

(51) Int. Cl.

| | |
|---|---|
| ***G03G 21/10*** | (2006.01) |
| ***G03G 21/00*** | (2006.01) |
| ***G03G 21/12*** | (2006.01) |
| ***G03G 21/16*** | (2006.01) |

(52) U.S. Cl.
CPC ..... *G03G 21/0011* (2013.01); *G03G 21/105* (2013.01); *G03G 21/12* (2013.01); *G03G 21/1671* (2013.01); *G03G 21/1814* (2013.01); *G03G 21/1832* (2013.01); *G03G 21/1676* (2013.01); *G03G 21/185* (2013.01)

(58) Field of Classification Search
USPC ..... 399/111
See application file for complete search history.

(56) References Cited

U.S. PATENT DOCUMENTS

| | | | |
|---|---|---|---|
| 6,608,980 | B2 | 8/2003 | Murayama et al. |
| 6,714,752 | B2 | 3/2004 | Ueno et al. |
| 6,823,153 | B2 | 11/2004 | Ueno et al. |
| 6,829,455 | B2 | 12/2004 | Yasumoto et al. |
| 6,834,175 | B2 | 12/2004 | Murayama et al. |
| 6,898,391 | B2 | 5/2005 | Numagami et al. |
| 6,912,365 | B2 | 6/2005 | Ueno et al. |
| 6,954,600 | B2 | 10/2005 | Fujita et al. |
| 6,954,601 | B2 | 10/2005 | Numagami et al. |
| 6,968,146 | B1 | 11/2005 | Fujita et al. |
| 6,970,668 | B2 | 11/2005 | Ueno et al. |
| 6,978,099 | B2 | 12/2005 | Ueno et al. |
| 7,003,247 | B2 | 2/2006 | Koishi et al. |
| 7,062,200 | B2 | 6/2006 | Ueno et al. |
| 7,092,658 | B2 | 8/2006 | Yasumoto et al. |
| 7,139,502 | B2 | 11/2006 | Koishi et al. |
| 7,158,749 | B2 | 1/2007 | Ueno et al. |
| 7,164,875 | B2 | 1/2007 | Miyabe et al. |
| 7,174,122 | B2 | 2/2007 | Fujita et al. |
| 7,184,690 | B2 | 2/2007 | Ueno et al. |
| 7,209,682 | B2 | 4/2007 | Numagami et al. |
| 7,248,810 | B2 | 7/2007 | Miyabe et al. |
| 7,315,710 | B2 | 1/2008 | Ueno et al. |
| 7,366,452 | B2 | 4/2008 | Fujita et al. |
| 7,440,715 | B2 | 10/2008 | Numagami et al. |
| 7,450,877 | B2 | 11/2008 | Miyabe et al. |
| 7,457,566 | B2 | 11/2008 | Koishi et al. |
| 7,483,646 | B2 | 1/2009 | Ueno et al. |
| 7,630,665 | B2 | 12/2009 | Ueno et al. |
| 7,702,251 | B2 | 4/2010 | Miyabe et al. |
| 7,720,408 | B2 | 5/2010 | Ueno et al. |
| 7,720,412 | B2 | 5/2010 | Anan et al. |
| 7,813,668 | B2 | 10/2010 | Ueno et al. |
| 7,945,185 | B2 | 5/2011 | Miyabe et al. |
| 8,155,554 | B2 | 4/2012 | Miyabe et al. |
| 8,229,320 | B2 | 7/2012 | Kimizuka et al. |
| 8,233,821 | B2 | 7/2012 | Miyabe et al. |
| 8,270,879 | B2 | 9/2012 | Numata et al. |
| 8,275,283 | B2 | 9/2012 | Uneme et al. |
| 8,275,286 | B2 | 9/2012 | Ueno et al. |
| 8,280,278 | B2 | 10/2012 | Ueno et al. |
| 8,295,734 | B2 | 10/2012 | Ueno et al. |
| 8,369,748 | B2 | 2/2013 | Ueno et al. |
| 8,391,748 | B2 | 3/2013 | Miyabe et al. |
| 8,401,441 | B2 | 3/2013 | Uneme et al. |
| 8,422,914 | B2 | 4/2013 | Hayashi et al. |
| 8,433,219 | B2 | 4/2013 | Miyabe et al. |
| 8,452,210 | B2 | 5/2013 | Ueno et al. |
| 8,494,399 | B2 | 7/2013 | Miyabe et al. |
| 8,494,411 | B2 | 7/2013 | Miyabe et al. |
| 8,521,060 | B2 | 8/2013 | Numata et al. |
| 8,532,533 | B2 | 9/2013 | Ueno et al. |
| 8,630,564 | B2 | 1/2014 | Ueno et al. |
| 8,670,688 | B2 | 3/2014 | Ueno et al. |
| 8,676,090 | B1 | 3/2014 | Ueno et al. |
| 8,682,215 | B1 | 3/2014 | Ueno et al. |
| 8,687,994 | B2 | 4/2014 | Nakamura et al. |
| 8,874,004 | B2 | 10/2014 | Takasaka et al. |
| 9,069,289 | B2 | 6/2015 | Batori et al. |
| 9,116,466 | B2 | 8/2015 | Makiguchi et al. |
| 9,052,638 | B2 | 9/2015 | Matsumaru et al. |
| 9,164,424 | B2 | 10/2015 | Nakamura et al. |
| 9,164,430 | B2 | 10/2015 | Murakami et al. |
| 9,176,468 | B2 | 11/2015 | Ueno et al. |
| 9,182,733 | B2 | 11/2015 | Horikawa et al. |
| 9,188,906 | B2 | 11/2015 | Batori et al. |
| 9,229,371 | B2 | 1/2016 | Murakami et al. |
| 9,354,552 | B2 | 5/2016 | Takeuchi |
| 9,465,318 | B2 | 10/2016 | Takeuchi et al. |
| 9,477,201 | B2 | 10/2016 | Miyabe et al. |
| 9,494,890 | B2 | 11/2016 | Komatsu et al. |
| 9,523,942 | B2 | 12/2016 | Takeuchi et al. |
| 9,594,343 | B2 | 3/2017 | Miyabe et al. |
| 9,599,932 | B2 | 3/2017 | Takeuchi et al. |
| 9,678,471 | B2 | 6/2017 | Ueno et al. |
| 9,684,261 | B2 | 6/2017 | Miyabe et al. |
| 9,733,614 | B2 | 8/2017 | Ueno et al. |
| 9,746,826 | B2 | 8/2017 | Ueno et al. |
| 9,772,602 | B2 | 9/2017 | Ueno et al. |
| 9,817,333 | B2 | 11/2017 | Morioka et al. |
| 9,836,015 | B2 | 12/2017 | Morioka et al. |
| 9,836,021 | B2 | 12/2017 | Ueno et al. |
| 9,841,724 | B2 | 12/2017 | Morioka et al. |
| 9,841,727 | B2 | 12/2017 | Ueno et al. |
| 9,841,728 | B2 | 12/2017 | Ueno et al. |
| 9,841,729 | B2 | 12/2017 | Ueno et al. |
| 9,846,408 | B2 | 12/2017 | Ueno et al. |
| 9,851,685 | B2 | 12/2017 | Morioka et al. |
| 9,851,688 | B2 | 12/2017 | Morioka et al. |
| 9,857,764 | B2 | 1/2018 | Ueno et al. |
| 9,857,765 | B2 | 1/2018 | Ueno et al. |
| 9,857,766 | B2 | 1/2018 | Morioka et al. |
| 9,864,331 | B2 | 1/2018 | Ueno et al. |
| 9,864,333 | B2 | 1/2018 | Ueno et al. |
| 9,869,960 | B2 | 1/2018 | Ueno et al. |
| 9,874,846 | B2 | 1/2018 | Ueno et al. |
| 9,874,854 | B2 | 1/2018 | Ueno et al. |
| 9,886,002 | B2 | 2/2018 | Morioka et al. |
| 9,939,776 | B2 | 4/2018 | Morioka et al. |
| 9,989,892 | B2 | 6/2018 | Takeuchi et al. |
| 2006/0034640 | A1 | 2/2006 | Kim et al. |
| 2011/0038649 | A1 | 2/2011 | Miyabe et al. |
| 2016/0274536 | A1 | 9/2016 | Ueno et al. |
| 2017/0139349 | A1 | 5/2017 | Miyabe et al. |
| 2017/0168422 | A1 | 6/2017 | Takeuchi et al. |
| 2017/0248911 | A1 | 8/2017 | Miyabe et al. |
| 2017/0329279 | A1 | 11/2017 | Hirayama et al. |
| 2018/0004155 | A1 | 1/2018 | Ueno et al. |
| 2018/0039226 | A1 | 2/2018 | Takeuchi et al. |
| 2018/0113415 | A1 | 4/2018 | Morioka et al. |

FOREIGN PATENT DOCUMENTS

| | | | |
|---|---|---|---|
| JP | 2010-096827 A | | 4/2010 |
| JP | 2010096827 A | * | 4/2010 |
| JP | 2014-052475 A | | 3/2014 |

OTHER PUBLICATIONS

Extended Search Report in European Patent Application No. 18 175 015.9, dated Oct. 8, 2018.

* cited by examiner (a)

(b)

(a)

(b)

CARTRIDGE AND IMAGE FORMING APPARATUS

FIELD OF THE INVENTION AND RELATED ART

The present invention relates to a cartridge usable with an image forming apparatus using an electrophotographic process.

In the field of an electrophotographic image forming apparatus, there is known a structure in which elements such as a photosensitive drum as a rotatable member related to image formation and a process means acting on the photosensitive drum are integrated as a cartridge and dismountable from the image forming apparatus main assembly.

In such an image forming apparatus, in order to facilitate maintenance, process means such as a photosensitive drum, a charging means, a developing means, a cleaning means, and so on as described above are collected in a frame as a cartridge. Then, it is known to provide an image forming apparatus which can be easily maintained by dismountably mounting the cartridge to the image forming apparatus.

In such a cartridge type apparatus, waste toner produced by a cleaning process at the time of image formation is fed into a waste toner storage portion provided in the main assembly of the apparatus (JP 2014-52475).

SUMMARY OF THE INVENTION

The object of the present invention is to further develop the aforementioned prior art.

According to an aspect of the present invention, there is provided a cartridge detachably mountable to a main assembly of an image forming apparatus, said cartridge comprising a photosensitive member; a discharging path configured to permit movement of a developer removed from said photosensitive member, said discharging path including a developer discharge opening and a movable portion through which the developer is movable and which is movable between a retracted position in an upstream side with respect to a developer moving direction through said discharge opening and a advanced position in a downstream side with respect to the developer moving direction; and a sealing portion configured to close said discharging path by contacting said movable portion at a position different from that of said discharge opening.

According to another aspect of the present invention, there is provided a cartridge detachably mountable to a main assembly of an image forming apparatus, said cartridge comprising a photosensitive member; a feeding path configured to permit movement of a developer removed from said photosensitive member, said feeding path including a hollow inner cylinder, and a hollow outer cylinder surrounding an outer periphery of said inner cylinder and reciprocable along said inner cylinder between a retracted position and an advanced position; and a sealing portion for closing a developer flow path formed between said inner cylinder and said outer cylinder.

Figure 7:
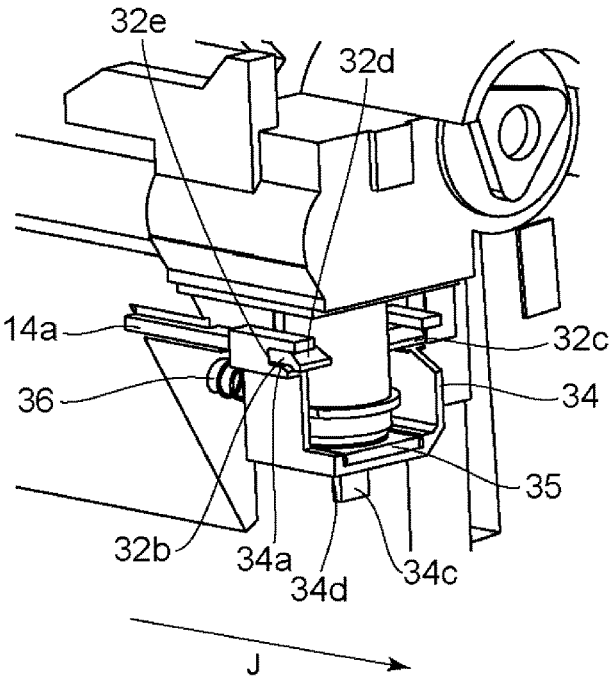
Figure 7:
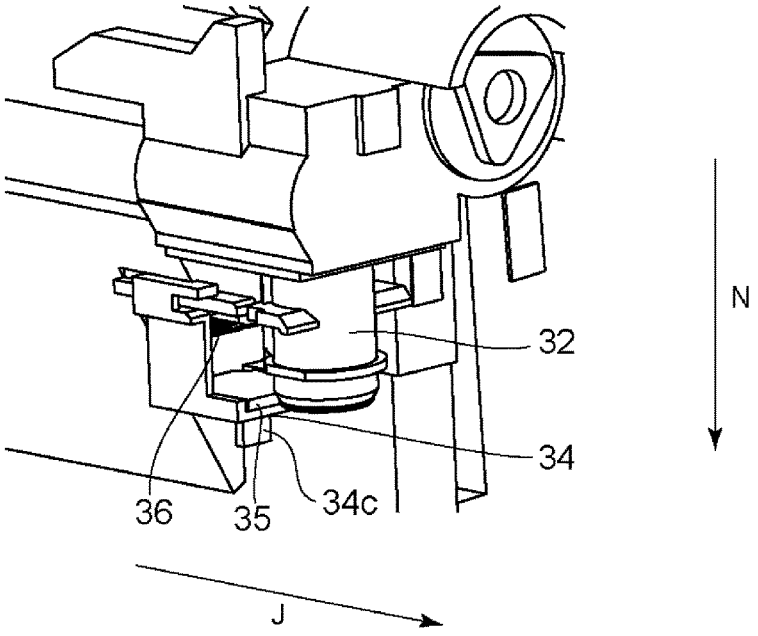

Parts (a) and (b) of FIG. 7 are perspective views illustrating the shutter structure of the waste toner discharge opening according to the embodiment.

Figure 8:
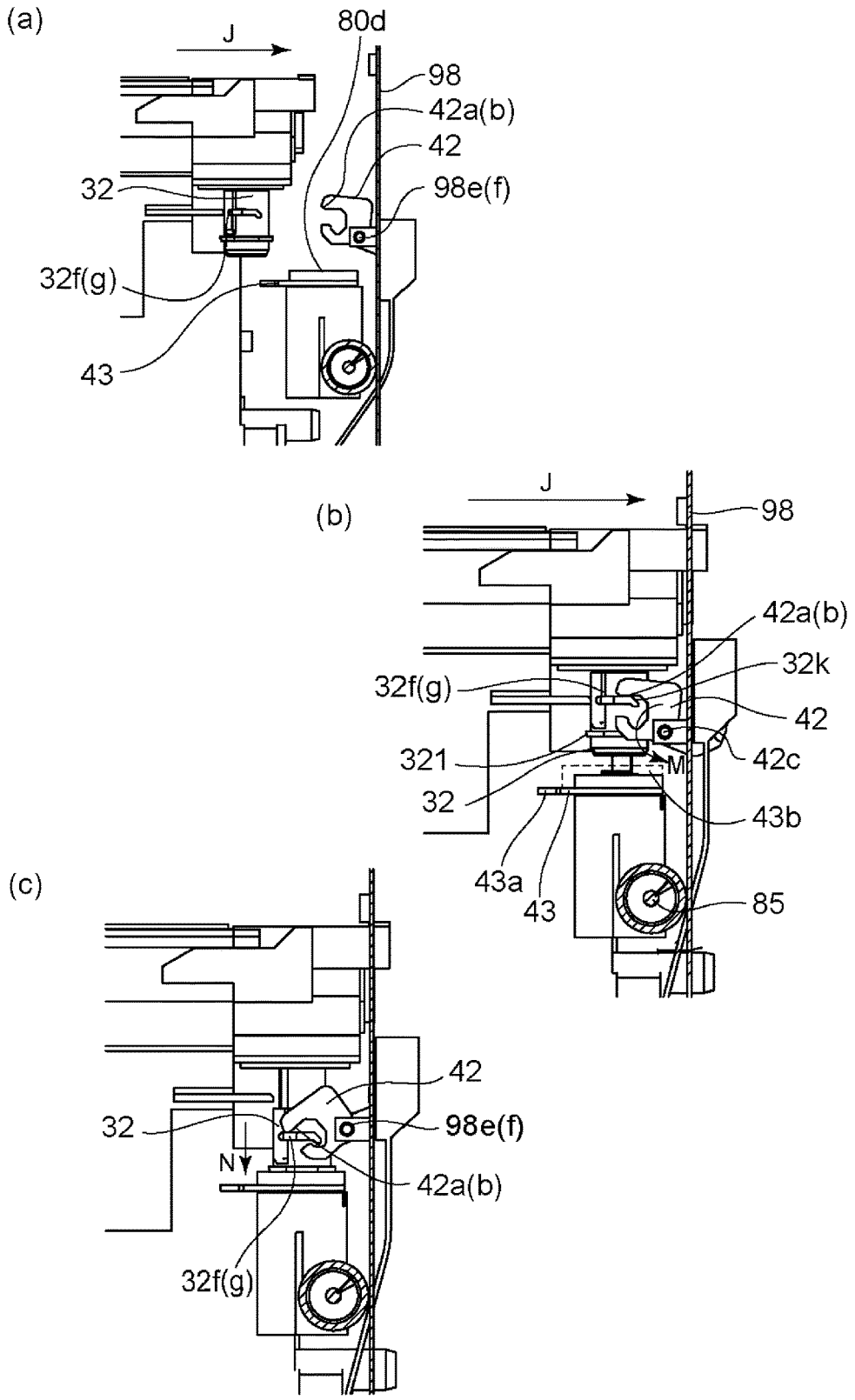

Parts (a), (b) and (c) of FIG. 8 are side views illustrating a method of connecting the waste toner discharging unit according to the embodiment.

Figure 9:
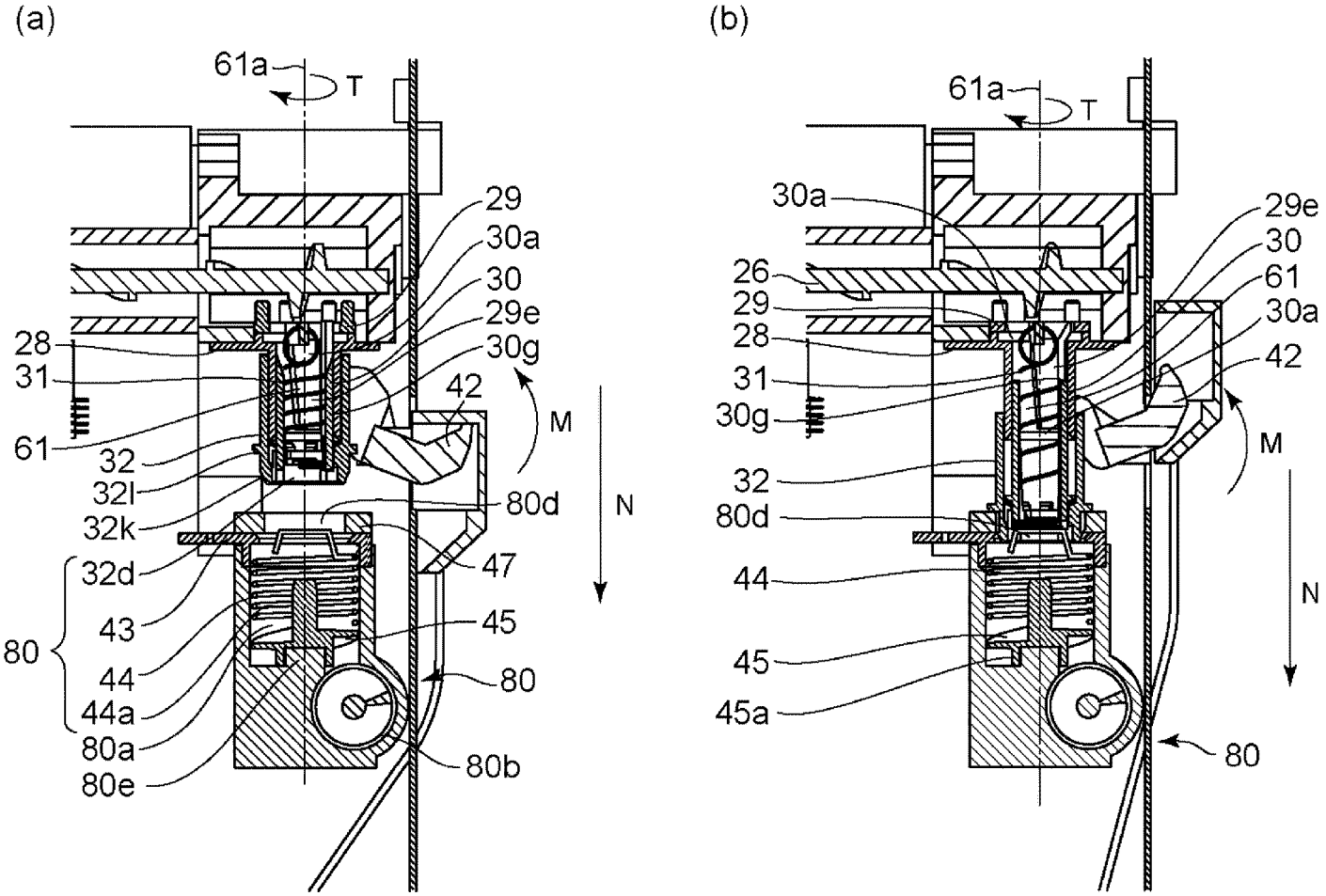

Parts (a) and (b) of FIG. 9 are cross-sectional views illustrating a method of engaging the process cartridge with the apparatus main assembly according to the embodiment.

Figure 10:
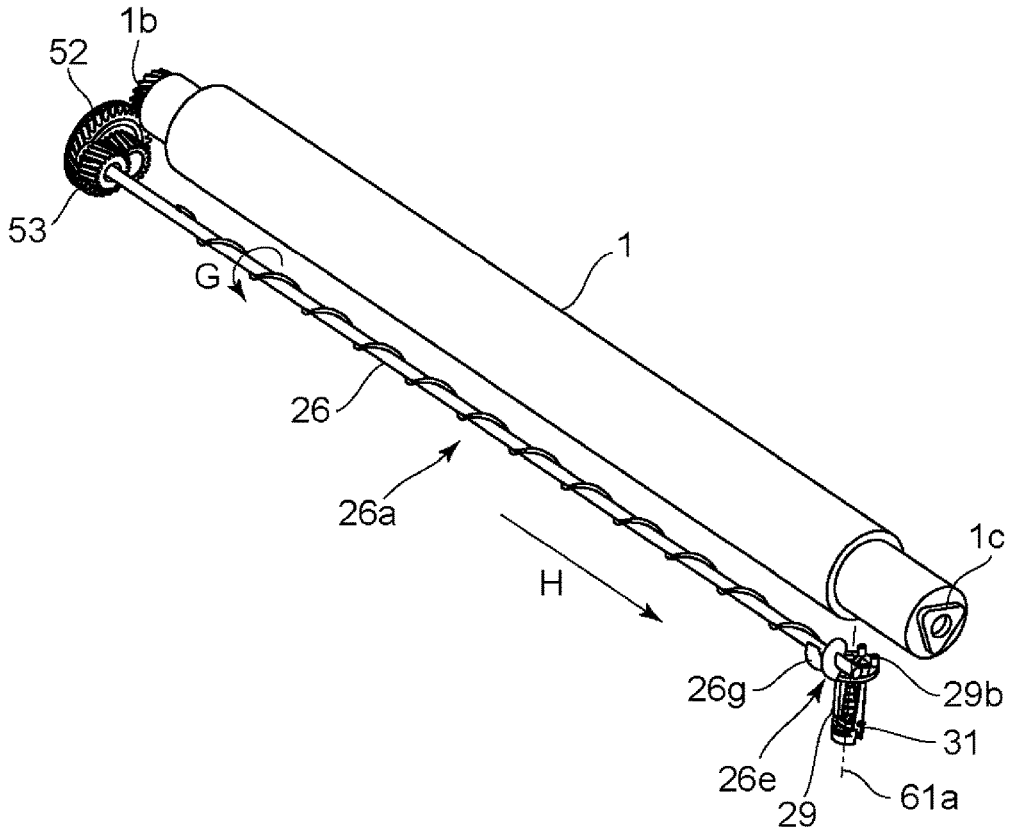

FIG. 10 is a schematic diagram illustrating a drive transmission structure of the waste toner discharging unit according to the embodiment.

Figure 11:
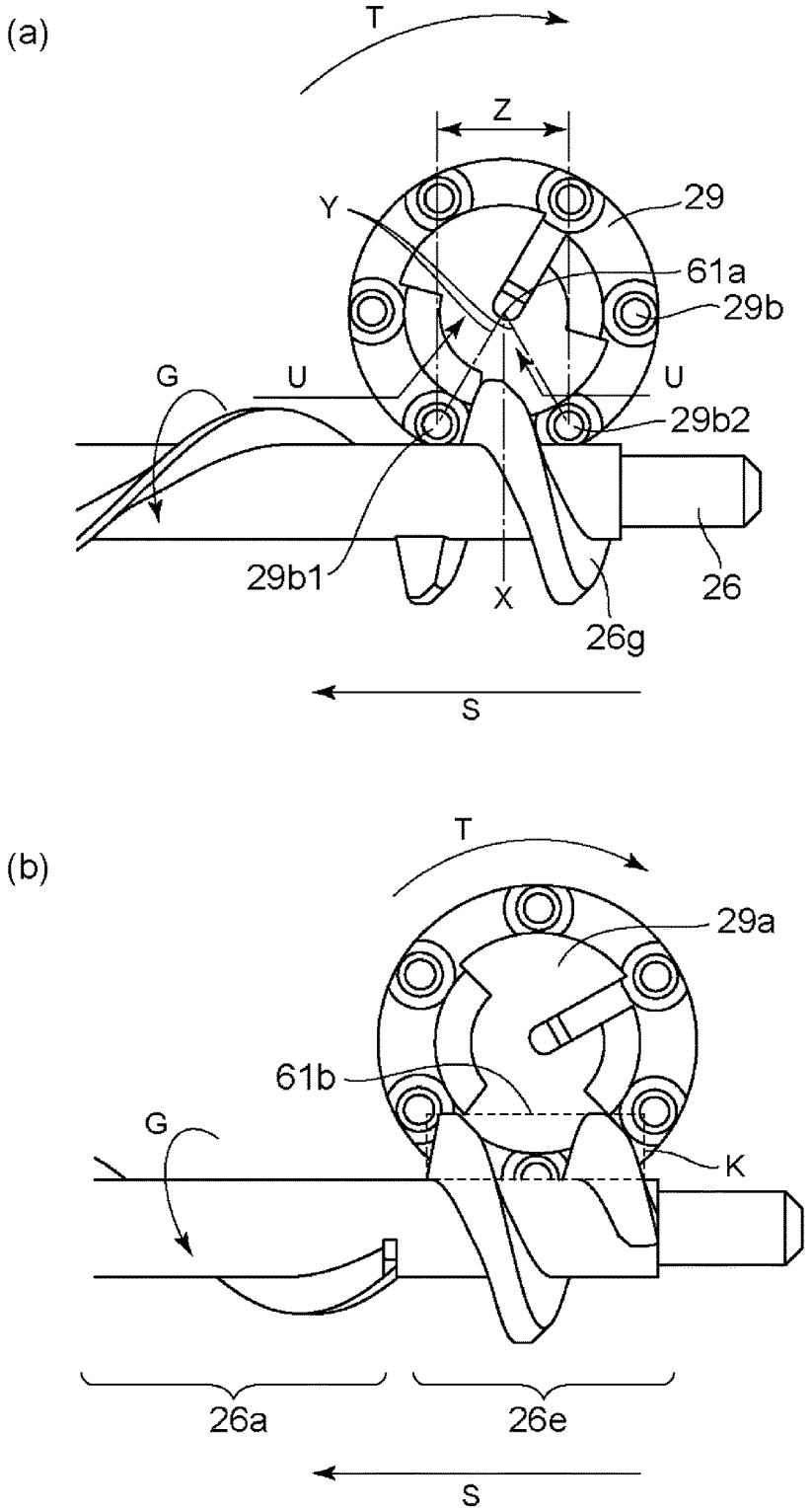

Parts (a) and (b) of FIG. 11 are illustrations of engagement between the feeding screw and the coupling of the process cartridge according to the embodiment.

Figure 12:
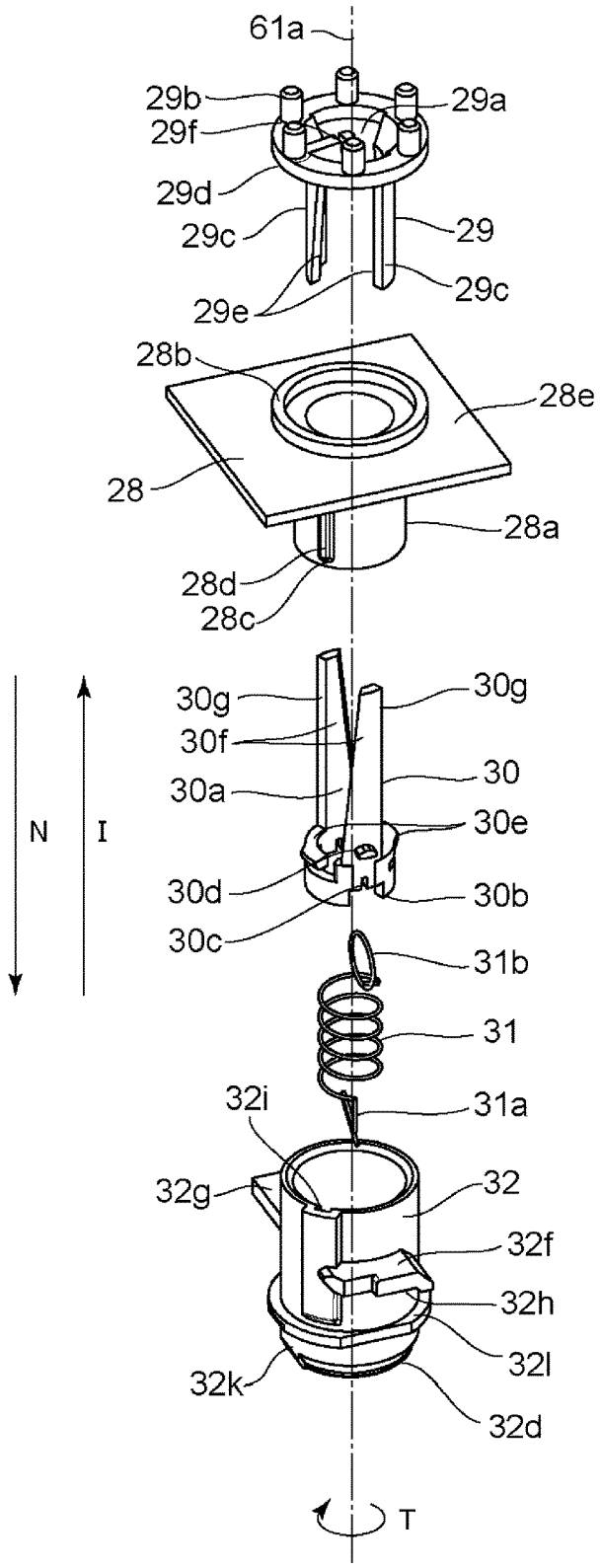

FIG. 12 is a view illustrating a driving connection structure of the waste toner discharging portion according to the embodiment.

Figure 13:
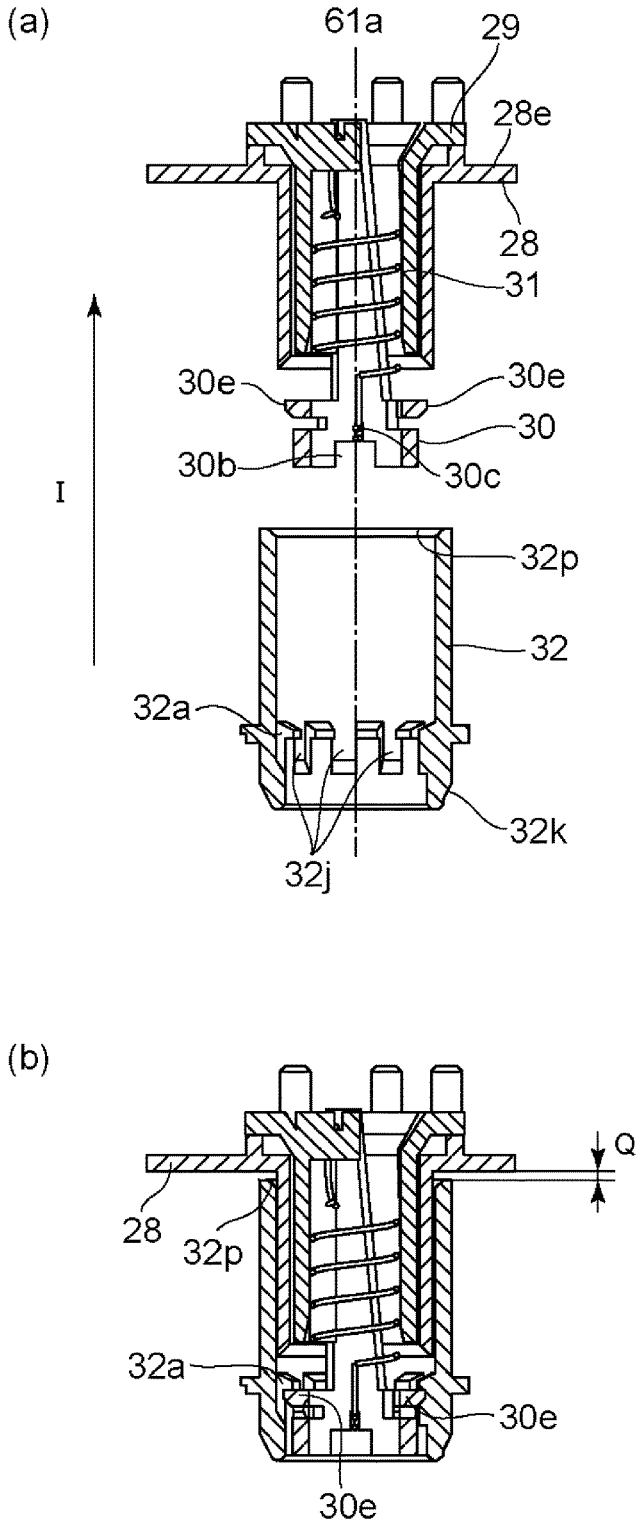

Parts (a) and (b) of FIG. 13 are assembly illustrations of the waste toner connecting member according to the embodiment.

Figure 14:
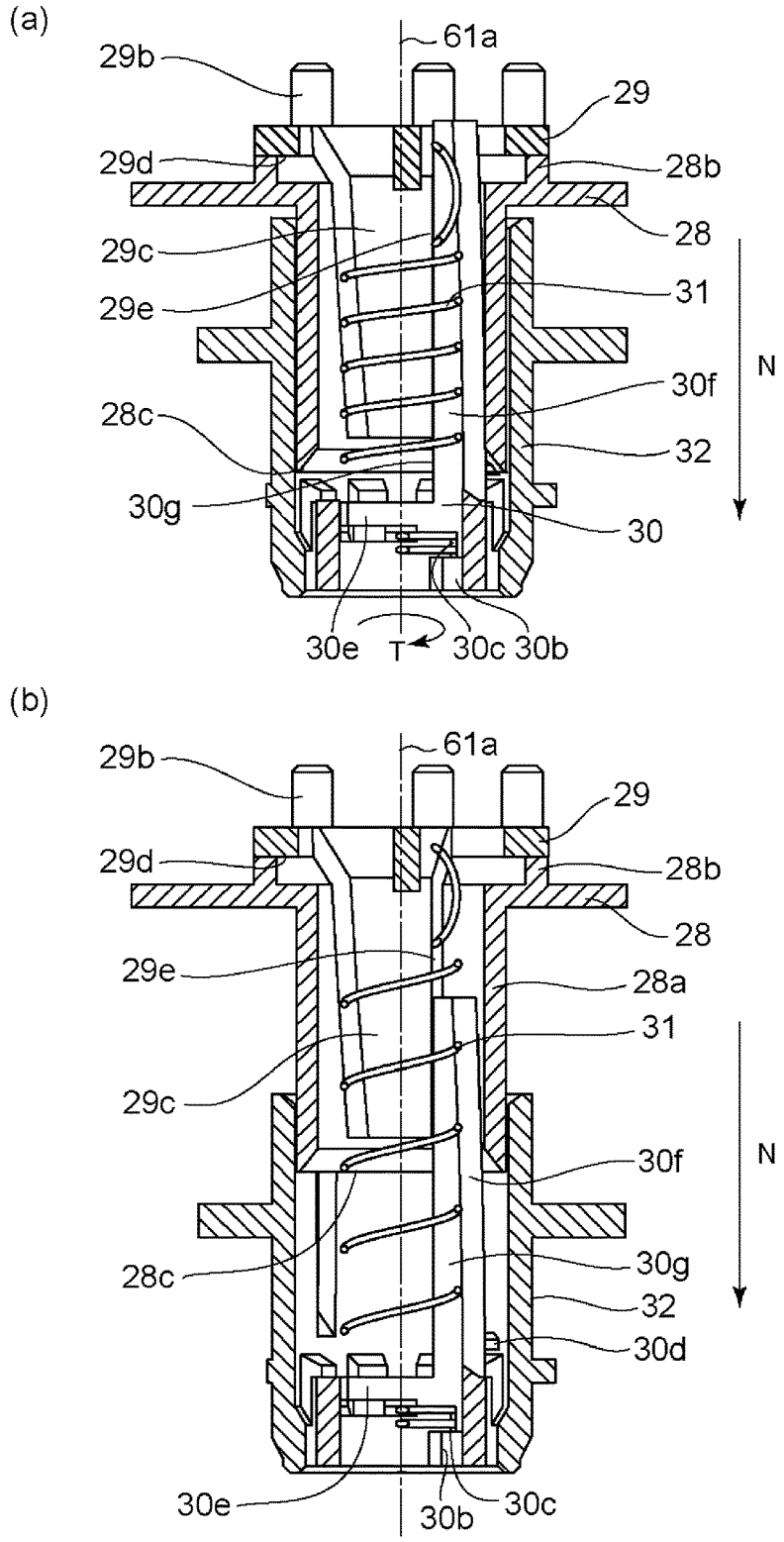

Parts (a) and (b) of FIG. 14 are schematic sectional views illustrating a component structure of the waste toner discharging portion according to the embodiment.

Figure 15:
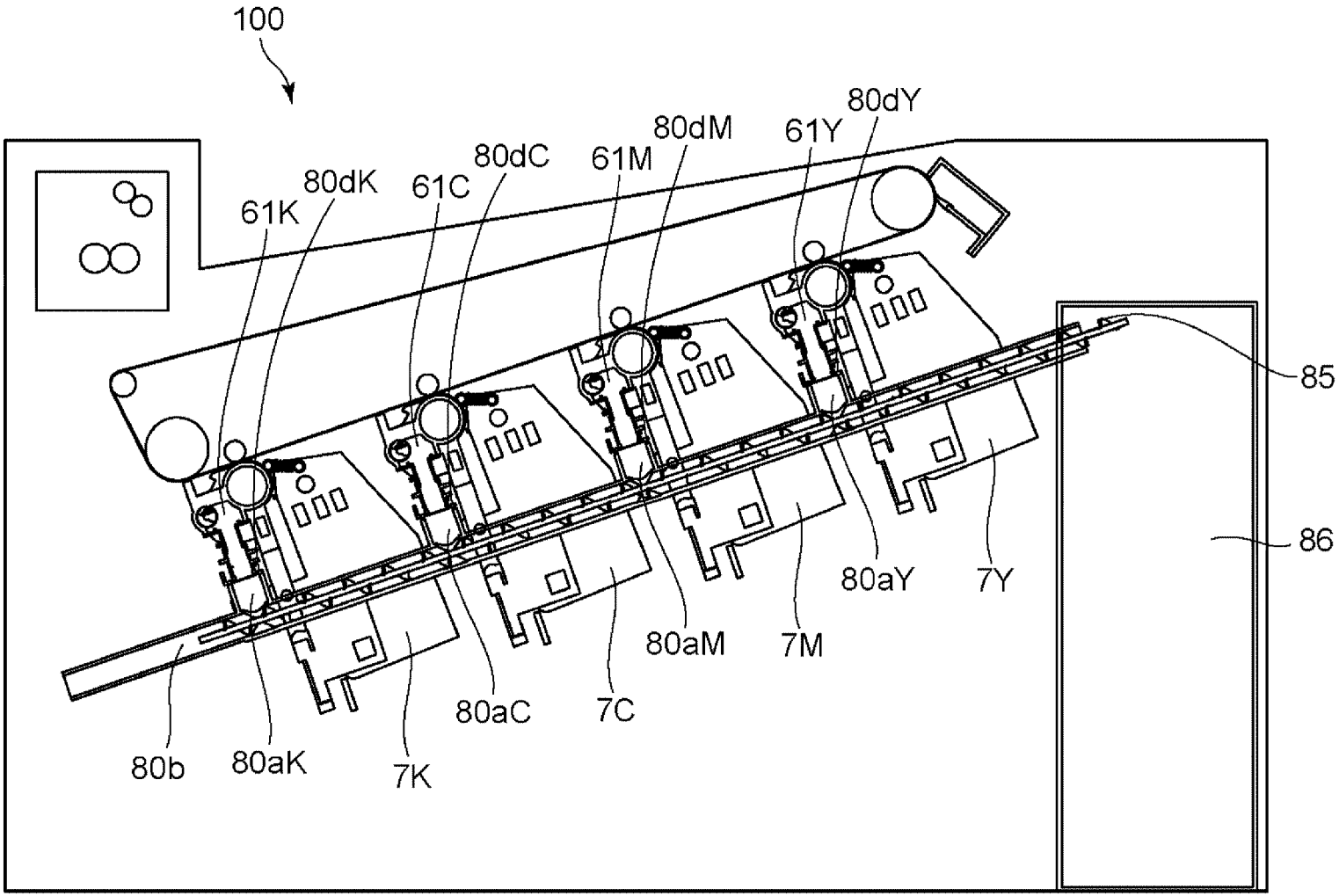

FIG. 15 is a schematic sectional view illustrating a feeding path of the removed toner according to the embodiment.

Figure 16:
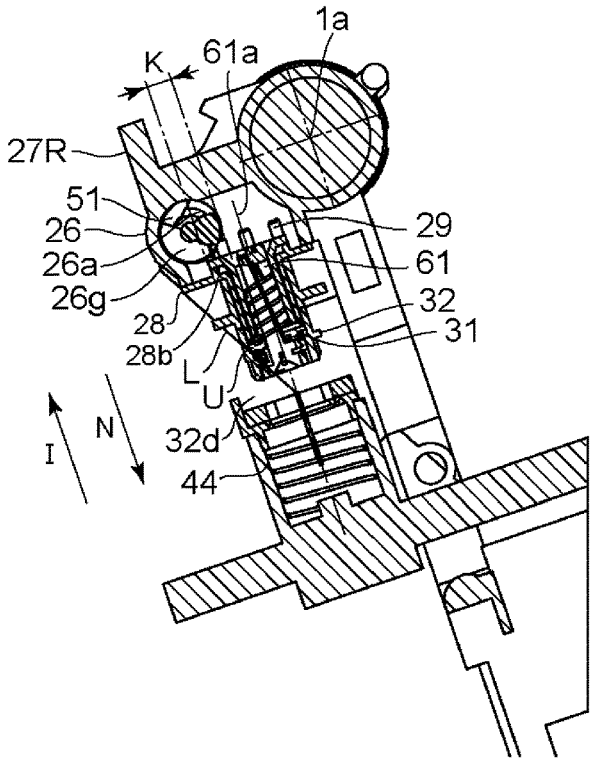
Figure 16:
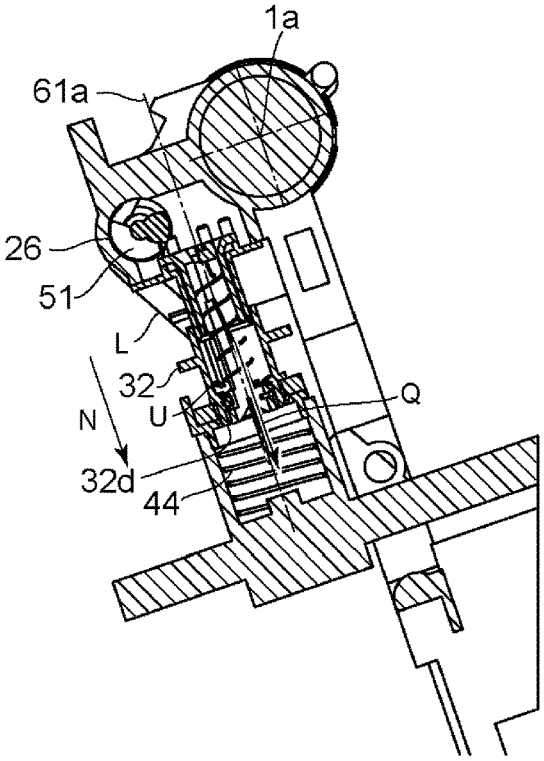

Parts (a) and (b) of FIG. 16 are cross-sectional views illustrating the cross-sectional position of the feeding screw of the process cartridge according to the embodiment.

Figure 17:
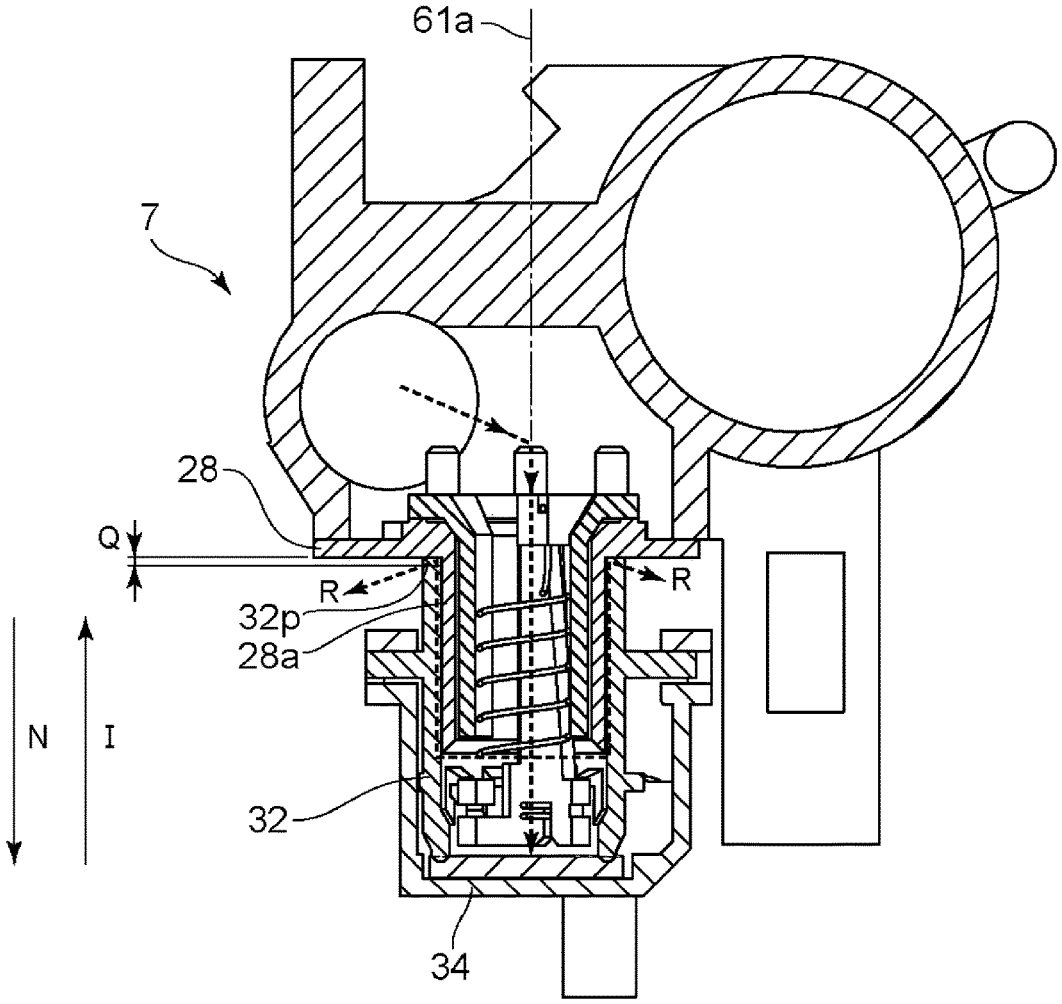

FIG. 17 is a cross-sectional view illustrating a gap of the waste toner feeding path according to the embodiment.

Figure 18:
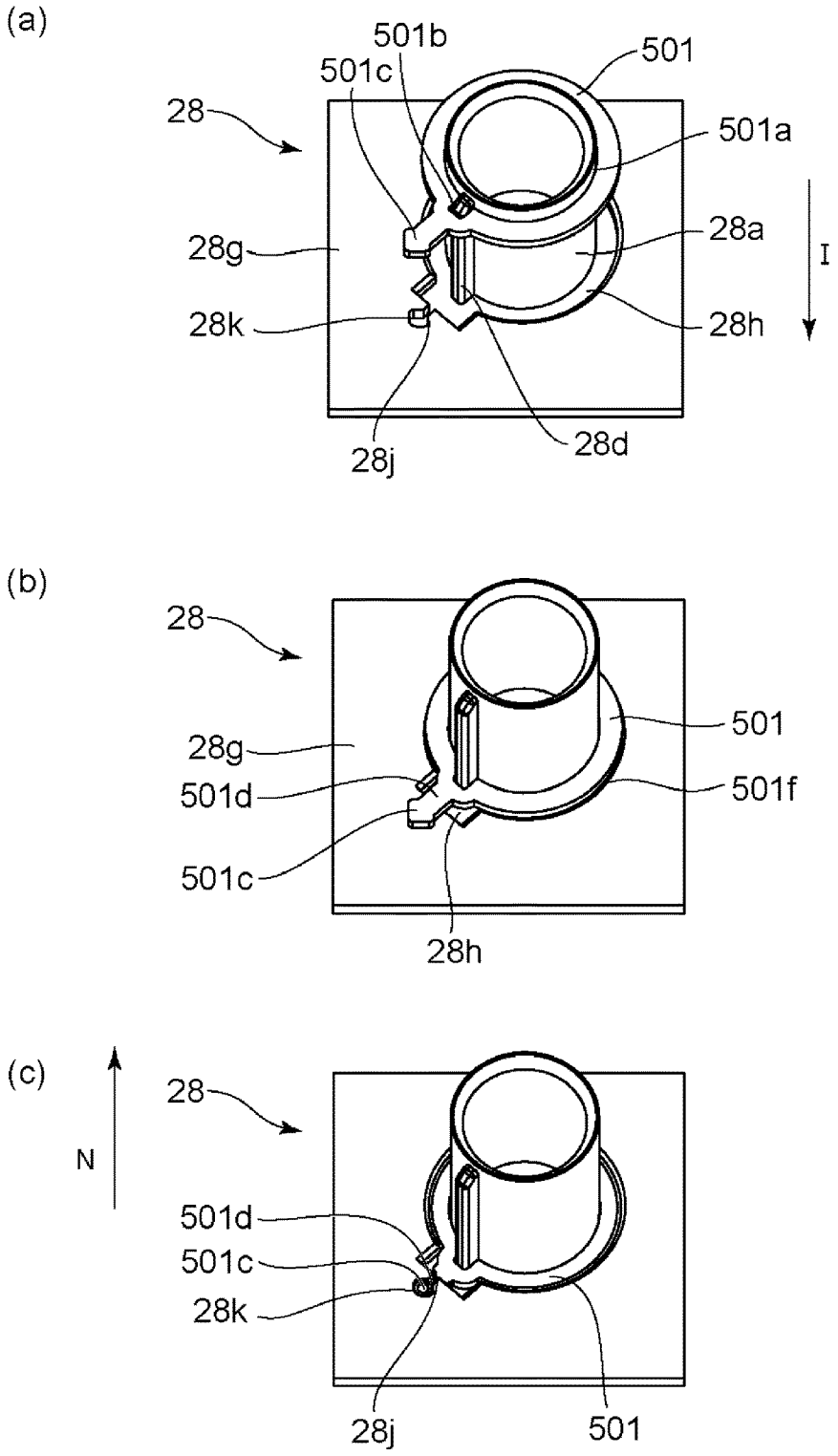

Parts (a), (b) and (c) of FIG. 18 are perspective views of a part explaining a method for mounting the seal according to the embodiment.

Figure 19:
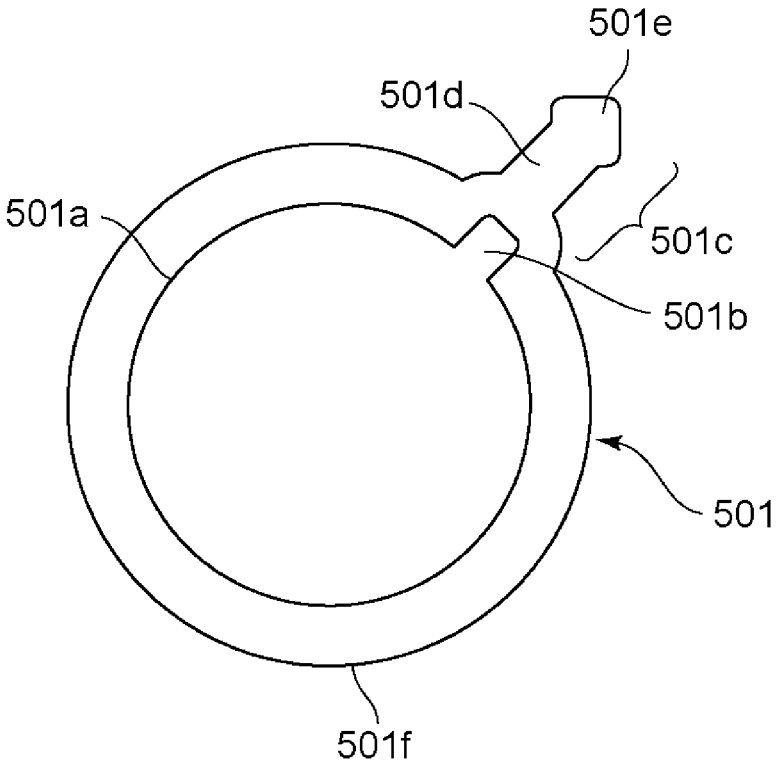

FIG. 19 is an external view of the seal according to the embodiment.

Figure 20:
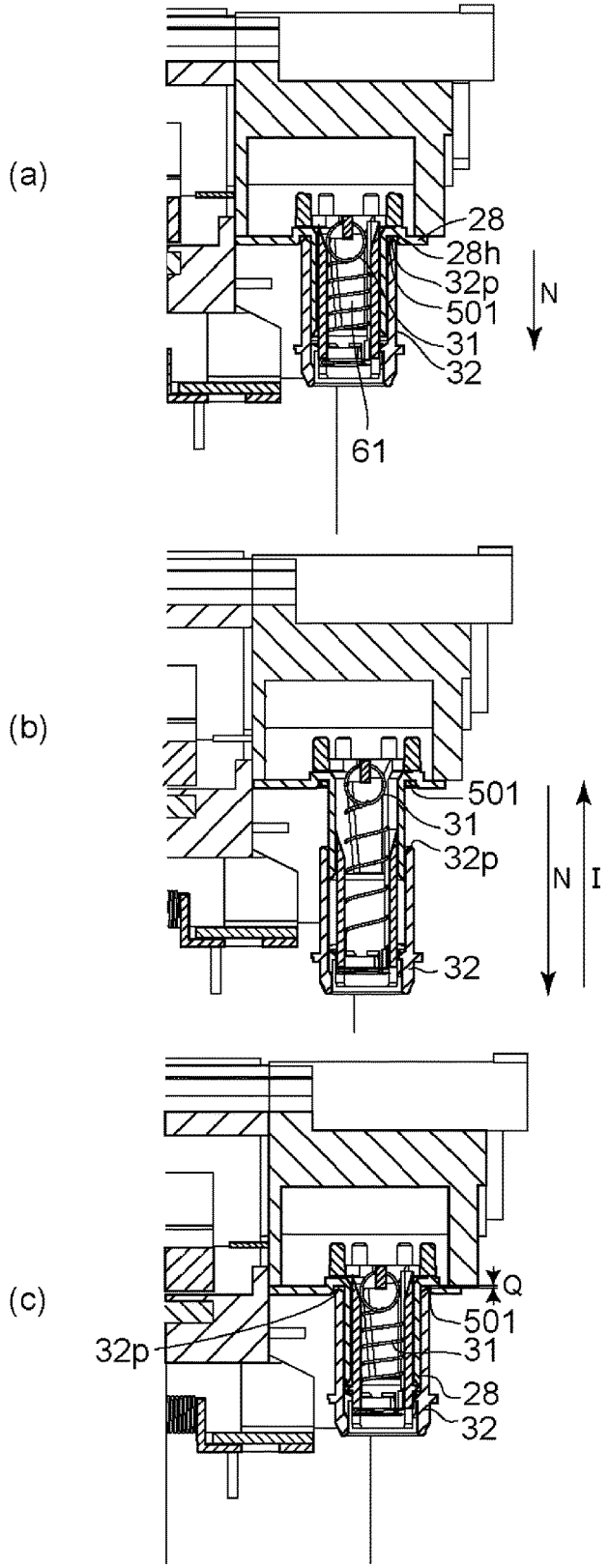

Parts (a), (b) and (c) of FIG. 20 are longitudinal-sectional views of the cartridge in the seal mounted state according to the embodiment.

Figure 21:
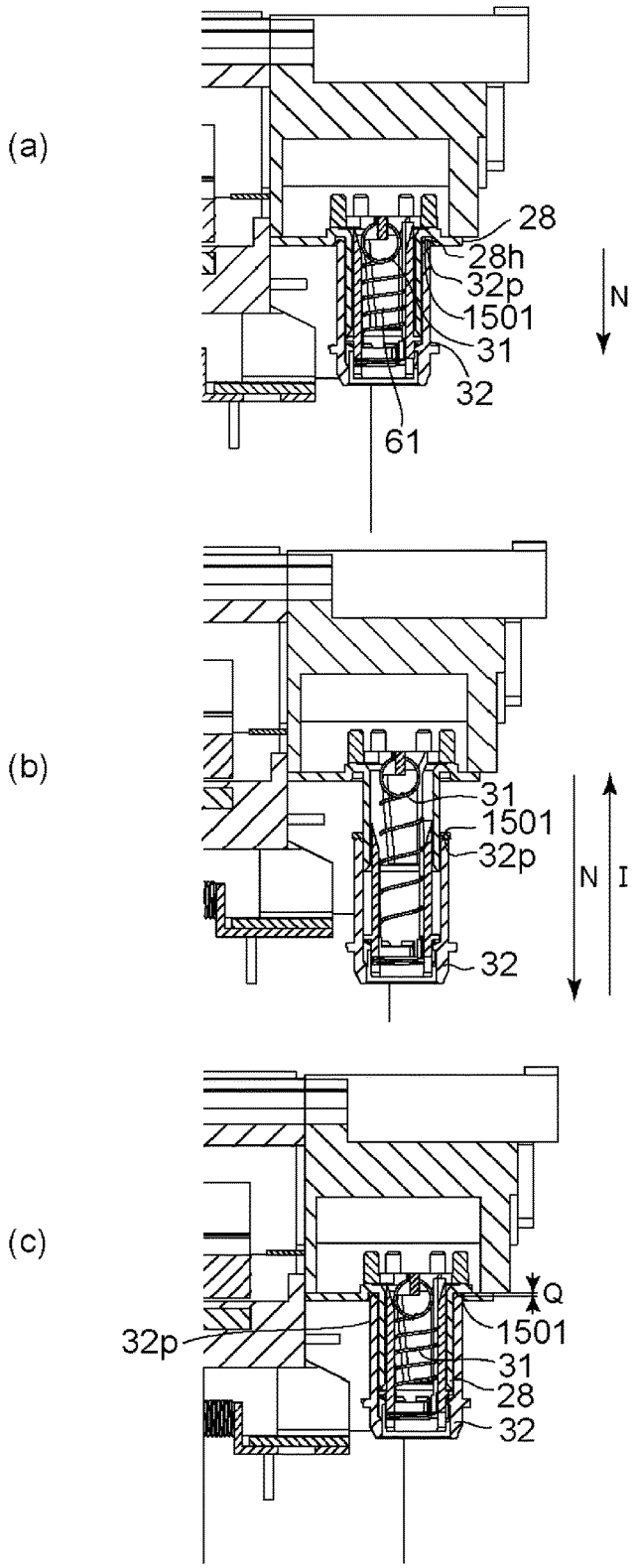

Parts (a), (b) and (c) of FIG. 21 are longitudinal-sectional views of a cartridge in a seal mounted state according to a modified example.

Figure 22:
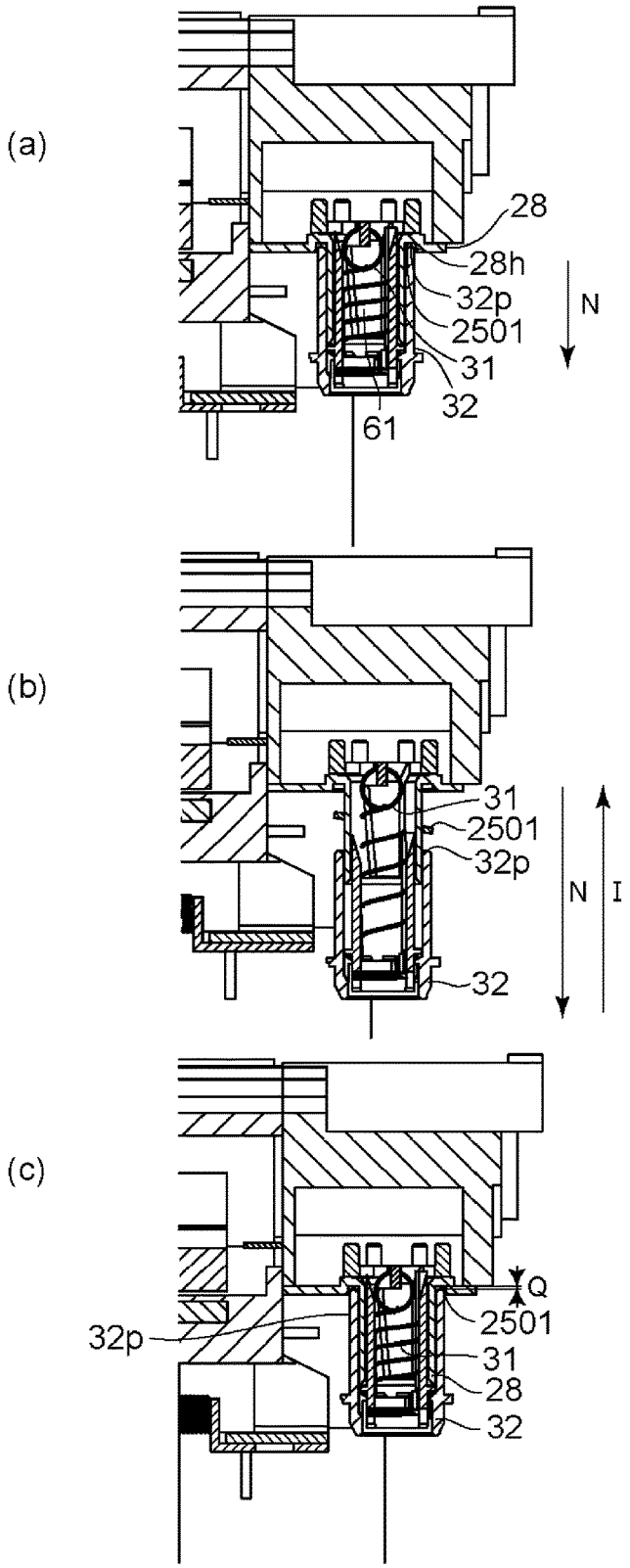

Parts (a), (b) and (c) of FIG. 22 are longitudinal-sectional views of a cartridge in a seal mounted state according to a modified example.

Figure 23:
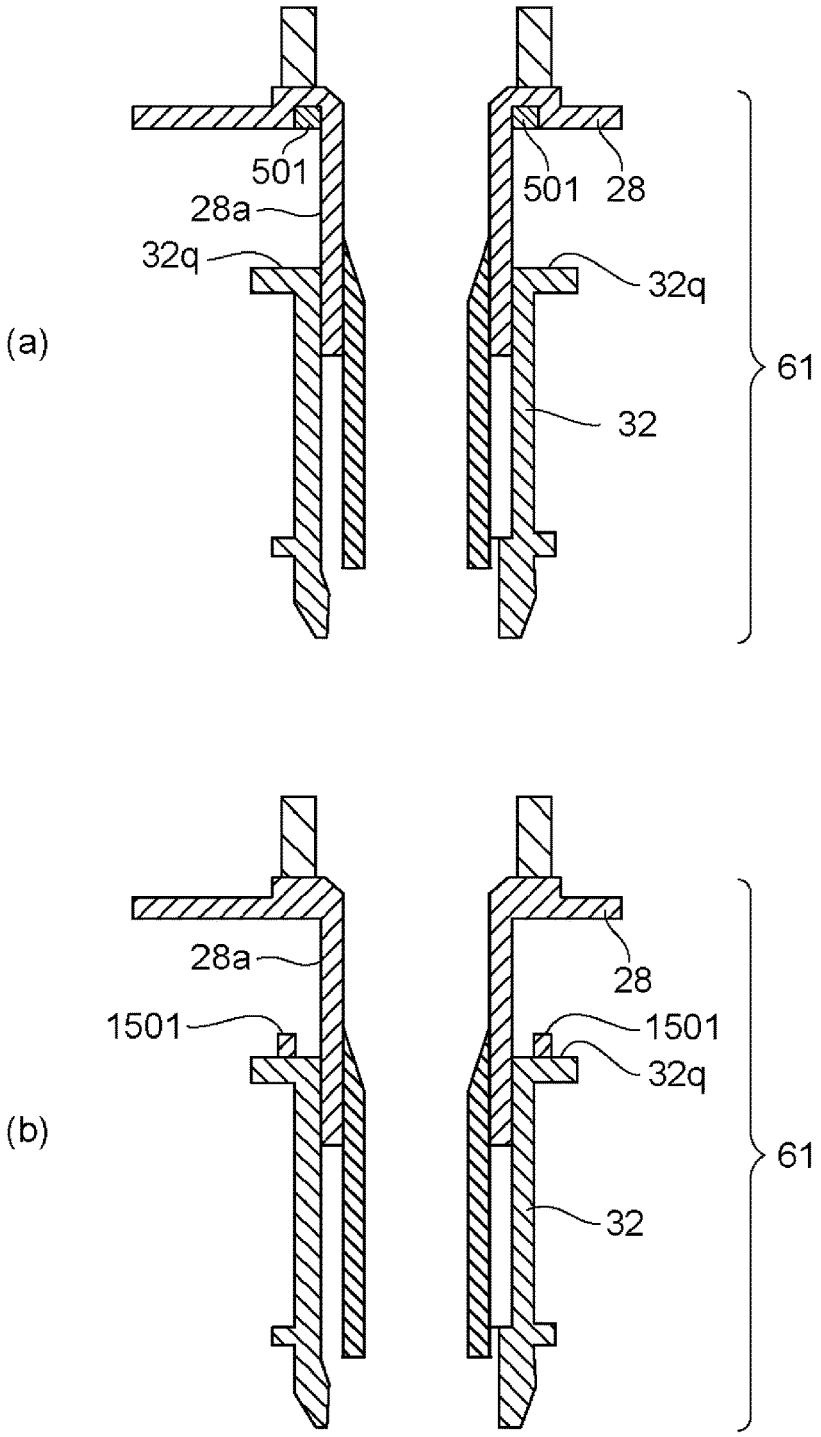

Parts (a) and (b) of FIG. 23 are longitudinal-sectional views of a cartridge in a seal mounted state according to a modified example.

DESCRIPTION OF THE EMBODIMENTS

Hereinafter, the image forming apparatus and the process cartridge of this embodiment will be described with reference to the drawings. An image forming apparatus forms an image on a recording medium by using an electrophotographic image forming process, for example. This includes, for example, an electrophotographic copying machine, an electrophotographic printer (for example, an LED printer, a laser beam printer, and so on), an electrophotographic facsimile machine, and the like. The process cartridge includes a photosensitive member and the like, and is dismountable to the main assembly of the electrophotographic image forming apparatus (hereinafter referred to as the apparatus main assembly). A photosensitive drum and a coupling member which are usable with a process cartridge are united with each other is called a drum unit.

In the following embodiment, a full-color image forming apparatus in which four process cartridges can be mounted and dismounted is explained. However, the number of process cartridges installed in the image forming apparatus is not limited to this. Similarly, the constituent elements disclosed in the embodiments are not intended to limit the material, position, dimensions, other numerical values, and so on, unless otherwise specified. Unless otherwise specified, "above" means upward in the direction of gravity when the image forming apparatus is installed.

[Brief Description of Image Forming Apparatus]

Hereinafter, the operation relating to image formation and the feeding of waste toner in the image forming apparatus of this embodiment will be briefly described.

(Regarding Main Assembly of Image Forming Apparatus)

Figure 2:
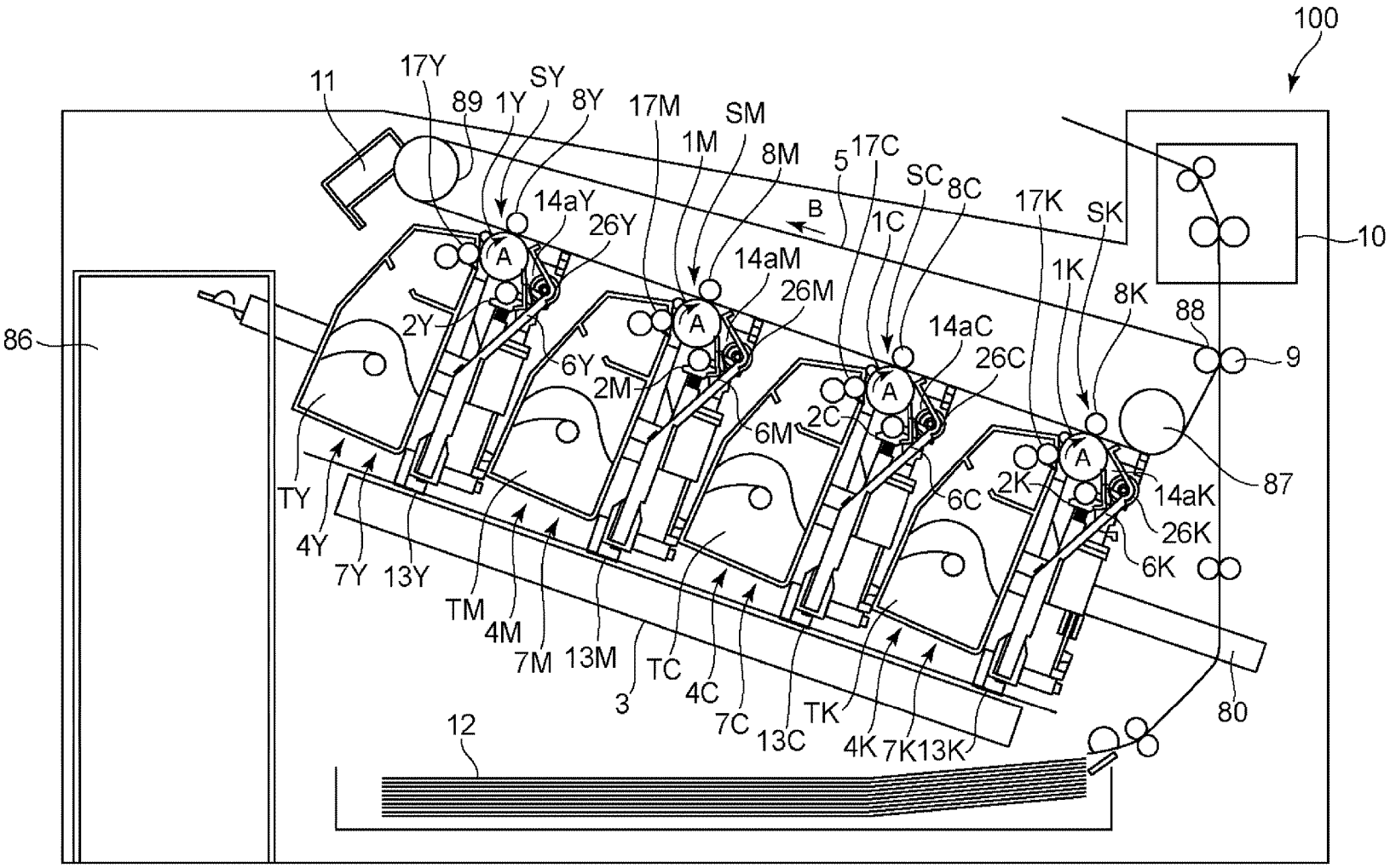
FIG. 2 is an illustration of the electrophotographic image forming apparatus according to the embodiment.

Referring to FIG. 2 first, the overall structure of the electrophotographic image forming apparatus (image forming apparatus) according to this embodiment will be described. FIG. 2 is a schematic sectional view of the image forming apparatus 100 of this embodiment.

As shown in FIG. 2, the image forming apparatus 100 includes a plurality of image forming units. Specifically, it comprises the first, second, third, and fourth image forming units SY, SM, SC, SK for forming images of respective colors of yellow (Y), magenta (M), cyan (C), and black (K). In this embodiment, the first to fourth image forming units SY, SM, SC and SK are disposed in a line in a direction crossing the vertical direction.

In this embodiment, the structure and operation of the first to fourth image forming stations are substantially the same except that the colors of the images to be formed are different. Therefore, hereinafter, Y, M, C, K will be omitted and general explanation will be given when there is no particular distinction required.

That is, in this embodiment, the image forming apparatus 100 includes four photosensitive drums 1 (1Y, 1M, 1C, 1K). The photosensitive drum 1 rotates in the direction of the arrow A in the drawing. A charging roller 2 and a scanner unit (exposure device) 3 are disposed around the photosensitive drum 1.

Here, the charging roller 2 is charging means for uniformly charging the surface of the photosensitive drum 1. The scanner unit 3 is exposure means for forming an electrostatic image (electrostatic latent image) on the photosensitive drum 1 by irradiating a laser based on image information. Also, the developing devices (hereinafter referred to as developing units) 4 (4Y, 4M, 4C, 4K) and cleaning blades 6 (6Y, 6M, 6C, 6K) as cleaning means (cleaning member) are provided around the photosensitive drum 1.

Further, an intermediary transfer belt 5 as an intermediary transfer member for transferring the toner image on the photosensitive drum 1 to the recording material 12 is disposed so as to face the four photosensitive drums 1.

In this embodiment, the developing unit 4 uses a non-magnetic one-component developer, that is, a toner T as a developer.

Further, in this embodiment, the developing unit 4 performs contact development by bringing the developing roller 17 as a developer carrying member into contact with the photosensitive drum 1. The photosensitive drum 1 is an electrophotographic photosensitive member (hereinafter simply referred to as photosensitive member).

In this embodiment, the cleaning unit 13 has a photosensitive drum 1, a charging roller 2, and a cleaning blade 6 as a cleaning member. It has a waste toner accommodating portion 14*a* (14*a*Y, 14*a*M, 14*a*C, 14*a*K) as a storing portion for accommodating the untransferred residual toner (waste toner) remaining on the photosensitive drum 1 removed by the cleaning blade 6.

Further, in this embodiment, the developing unit 4 and the cleaning unit 13 are integrated into a cartridge to form a process cartridge 7. The process cartridge 7 is mountable to and dismountable from the image forming apparatus 100 via mounting means (guide, guide mechanism) such as a mounting guide (not shown), a positioning member (not shown) provided in the main assembly of the image forming apparatus.

In this embodiment, the process cartridges 7 for the respective colors have the same shape. Toners T (TY, TM, TC, TK) of each color of yellow (Y), magenta (M), cyan (C) and black (K) are accommodated in the process cartridge 7.

The intermediary transfer belt 5 abuts against all the photosensitive drums 1 and rotates in the direction of the arrow B in the drawing. The intermediary transfer belt 5 is wound around a plurality of support members (drive roller 87, secondary transfer opposed roller 88, driven roller 89).

On a inner peripheral surface side of the intermediary transfer belt 5, four primary transfer rollers 8 (8Y, 8M, 8C, 8K) as primary transfer means are juxtaposed so as to face each photosensitive drum 1. A secondary transfer roller 9 as a secondary transfer unit is disposed at a position facing the secondary transfer opposing roller 88 on the outer peripheral surface side of the intermediary transfer belt 5.

At the time of image formation, the surface of the photosensitive drum 1 is first uniformly charged by the charging roller 2. Subsequently, the surface of the charged photosensitive drum 1 is scanned and exposed by the laser light corresponding to the image information emitted from the scanner unit 3. As a result, an electrostatic latent image is formed on the photosensitive drum 1 in accordance with the image information. then, the electrostatic latent image formed on the photosensitive drum 1 is developed into a toner image by the developing unit 4. In other words, the photosensitive drum 1 is a rotatable member (image bearing member) which carries the image (toner image) formed on the surface thereof with toner. The toner image formed on the photosensitive drum 1 is transferred (primary transfer) onto the intermediary transfer belt 5 by the function of the primary transfer roller 8.

The recording material 12 carrying the transferred toner image is fed to a fixing device 10 as fixing means. The fixing device 10 applies heat and pressure to the recording material 12, whereby the toner image is fixed on the recording material 12. The primary untransferred residual toner remaining on the photosensitive drum 1 after the primary transferring process is removed by the cleaning blade 6 as the cleaning member and collected.

The removed residual toner (hereinafter referred to as waste toner) is delivered from the process cartridge 7 to the apparatus main assembly 100, and is fed to a waste toner box 86 installed in the apparatus main assembly 100.

A part other than a unit dismountably provided from an image forming apparatus like a cartridge may be called an image forming apparatus main assembly (apparatus main assembly) (in order to distinguish it from an entire image forming apparatus).

[Process Cartridge]

Figure 3:
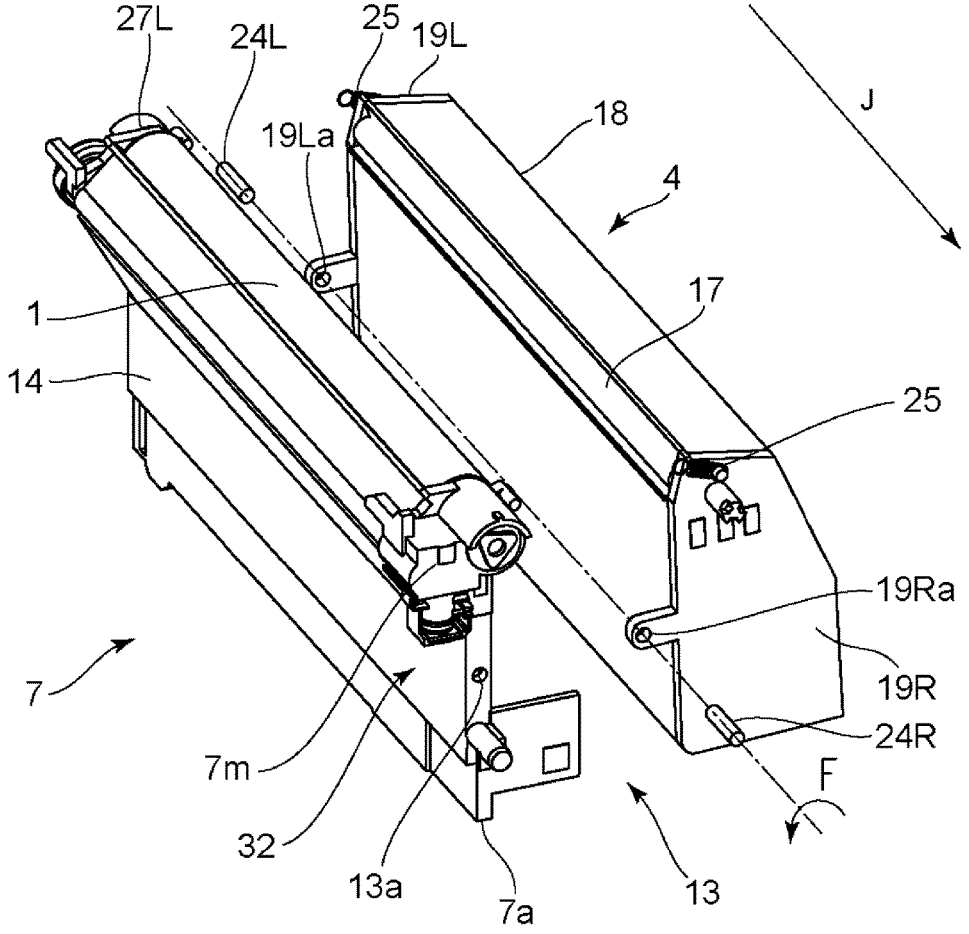
FIG. 3 is a perspective view of the process cartridge according to the embodiment.

Referring to FIG. 3, the overall structure of the process cartridge 7 to be mounted to the image forming apparatus 100 of this embodiment will be described. FIG. 3 is an exploded perspective view illustrating the developing unit 4 and the cleaning unit 13 or the like.

The process cartridge 7 integrally includes a developing device 4 and a cleaning unit 13. As shown in FIG. 3, the developing unit 4 has holes 19Ra, 19La provided in the bearing members 19R, 19L. In addition, the cleaning unit 13 includes holes 13*a* (13*a* R, 13*a* L (not shown), see FIG. 3) provided in the frame of the cleaning unit 13. The developing unit 4 and the cleaning unit 13 are connected so as to be rotatable around the shafts 24 (24R, 24L) fitted in the holes 19Ra, 19La and the holes 13*a*R, 13*a*L, respectively. The developing unit 4 is urged by the pressure spring 25. Therefore, at the time of image formation, the developing unit 4 rotates around the shaft 24 in the direction of the arrow F, whereby the photosensitive drum 1 and the developing roller 17 are in contact with each other. The developing roller 17 is a rotatable member (a developer carrying member, a developing member) which rotates while carrying toner (developer) on its surface. The developing roller 17 develops the latent image on the photosensitive drum 1 by supplying the toner to the photosensitive drum 1. The development bearing 19 (19R, 19L, see FIG. 3) is mounted to respective side portions of the developing frame 18. The developing frame 18 and the development bearing 19 constitute the frame 7 of the cartridge 7, and in more detail, it is a frame forming the developing unit 4. Each of these members such as and the developing roller 17 provided in the developing unit is supported by the frame.

Figure 4:
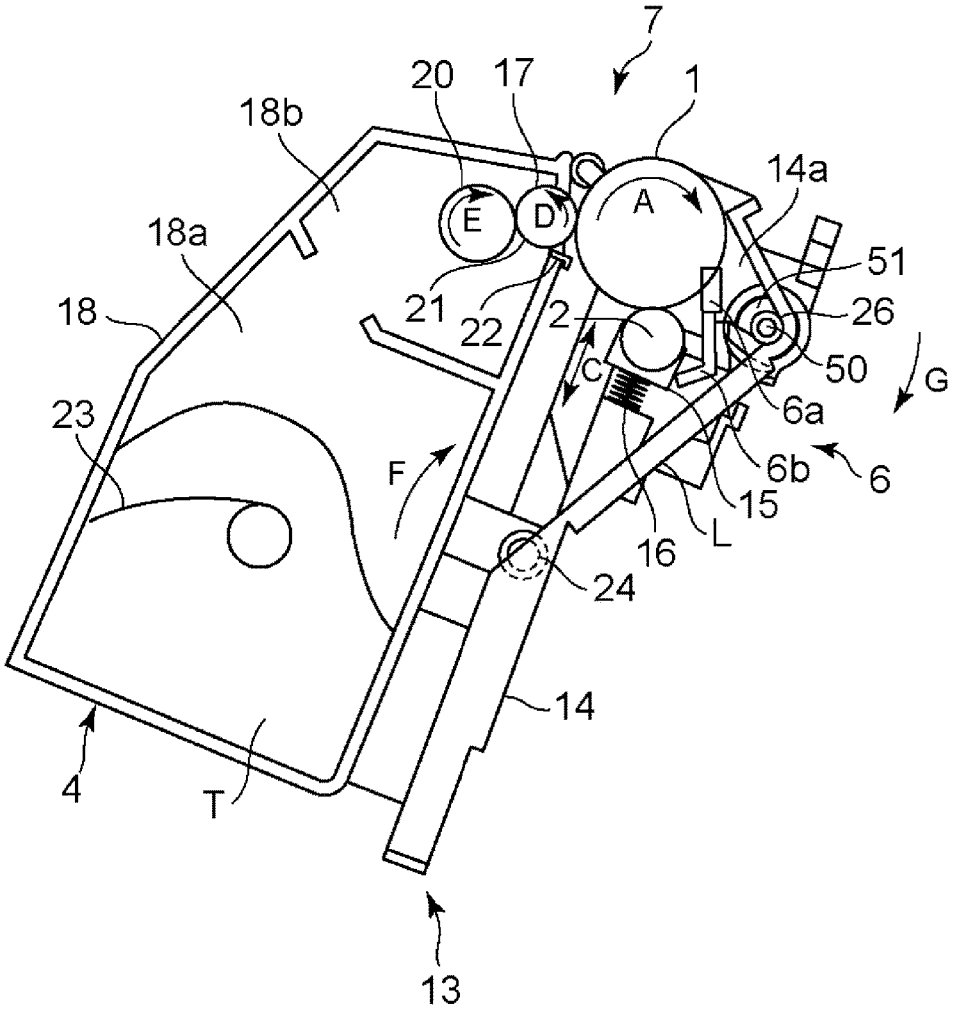
FIG. 4 is a schematic sectional view of the process cartridge according to the embodiment.

As shown in FIG. 4, the developing unit 4 includes a developer accommodating chamber (hereinafter referred to as a toner accommodating chamber) 18*a* and a developing chamber 18 *b* in which the developing roller 17 is provided. The toner accommodating chamber 18*a* and the developing chamber 18*b* are formed by the frame of the developing unit 4.

In the developing chamber 18*b*, a toner supply roller 20 (as a developer supply member which contacts the developing roller 17 and rotates in the direction of arrow E), a toner supply roller 20 and the developing blade 21 (as a developer regulating member for regulating the toner layer of the developing roller 17) are provided. The toner supply roller 20 is a roller for supplying toner to the developing roller 17. The toner supply roller 20 is a rotatable member which rotates while carrying toner on the surface thereof, and is a toner supply member. The developing blade 21 is integrated with the supporting member 22 by welding, for example. The toner accommodating chamber 18*a* of the developing frame 18 is provided with a stirring member 23 for stirring the contained toner and for feeding the toner to the toner supply roller 20.

(Cleaning Unit)

Referring to FIGS. 3 and 4, the cleaning unit 13 of the process cartridge 7 of this embodiment will be described.

As shown in FIG. 4, the cleaning unit 13 contains a cleaning frame 14 as a frame for supporting various elements in the cleaning unit 13. The photosensitive drum 1 is mounted to the cleaning frame 14 so as to be rotatable in the direction of the arrow A shown in FIG. 4 by the bearing members 27 (27R and 27L, FIG. 3). The cleaning frame 14 and the bearing member 27 are part of the frame of the cartridge 7, and in detail, they are frames constituting the cleaning unit 13. Each of the members such as the photosensitive drum 1 provided in the cleaning unit 13 is supported by these frames.

A charging roller bearing 15 is mounted to the cleaning frame 14 along a line passing through the rotation center of the charging roller 2 and the rotation center of the photosensitive drum 1.

Here, the charging roller bearing 15 is mounted movably in the direction of the arrow C shown in FIG. 3. The rotating shaft 2*a* of the charging roller 2 is rotatably mounted to the charging roller bearing 15. The charging roller bearing 15 is urged toward the photosensitive drum 1 by the charging roller pressing spring 16 as urging means.

As shown in FIG. 4, the cleaning blade 6 includes integrally an elastic member 6*a* for removing the untransferred residual toner (waste toner) from the surface of the photosensitive drum 1 after the primary transfer, and a support member 6*b* for supporting the elastic member. The cleaning blade 6 is fixed to the cleaning frame 14 by means such as screws at respective end portions in the longitudinal direction of the photosensitive drum 1.

The waste toner removed from the surface of the photosensitive drum 1 by the cleaning blade 6 falls in the direction of gravity in the space formed by the cleaning blade 6 and the cleaning frame 14 and is temporarily stored in the waste toner accommodating portion 14*a*.

Inside the waste toner accommodating portion 14*a*, a feeding screw 26 as a feeding member (cartridge side feeding member side) is provided. By this, the waste toner collected in the waste toner storing portion is fed to the one end side in the longitudinal direction of the process cartridge 7 by the feeding screw 26. The longitudinal direction of the process cartridge 7 can be regarded as substantially parallel to the rotation axis direction of the photosensitive drum 1.

Figure 5:
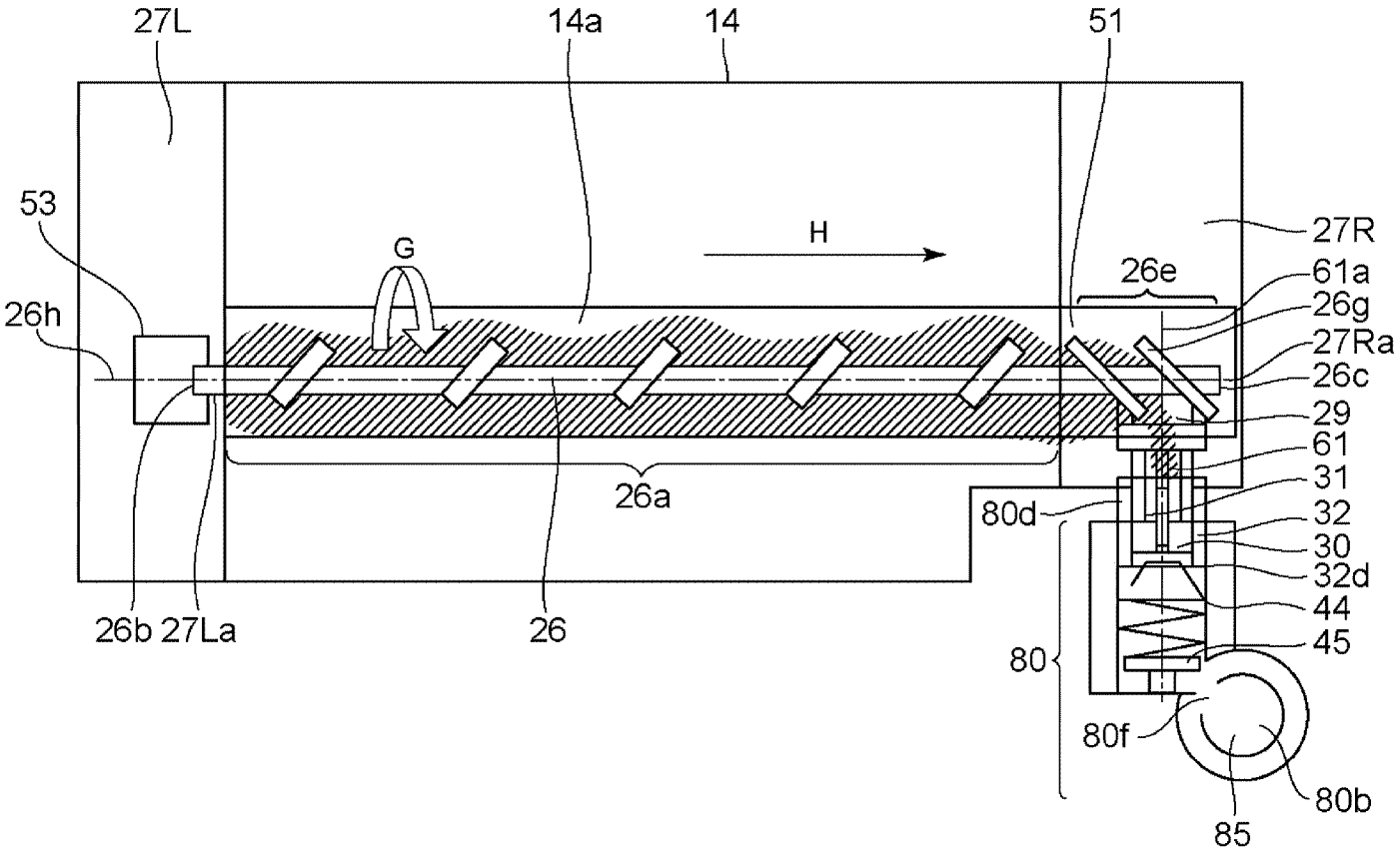
FIG. 5 is a schematic cross-sectional view illustrating the flow of the waste toner in the process cartridge according to the embodiment.

The feed of the waste toner in the longitudinal direction will be described referring to FIG. 5. FIG. 5 is a schematic sectional view illustrating a waste toner discharging structure of the process cartridge 7.

The waste toner fed in the direction of the arrow H by the feeding screw 26 passes through the first coupling 29, the second coupling 30, and the coupling member 32 provided at the longitudinal direction end portion of the process cartridge 7, and is fed to the waste toner receiving opening 80*d* of the main assembly.

Here, the path of the toner fed in the direction of arrow H by the feeding screw 26 is called a first feeding path 51. The toner path (the path after the first coupling 29) that is provided at one end side in the longitudinal direction of the cartridge 7 and intersects (orthogonally) with the first feed path is referred to as the second feed path 61.

(Outline of Mounting Operation)

Figure 6:
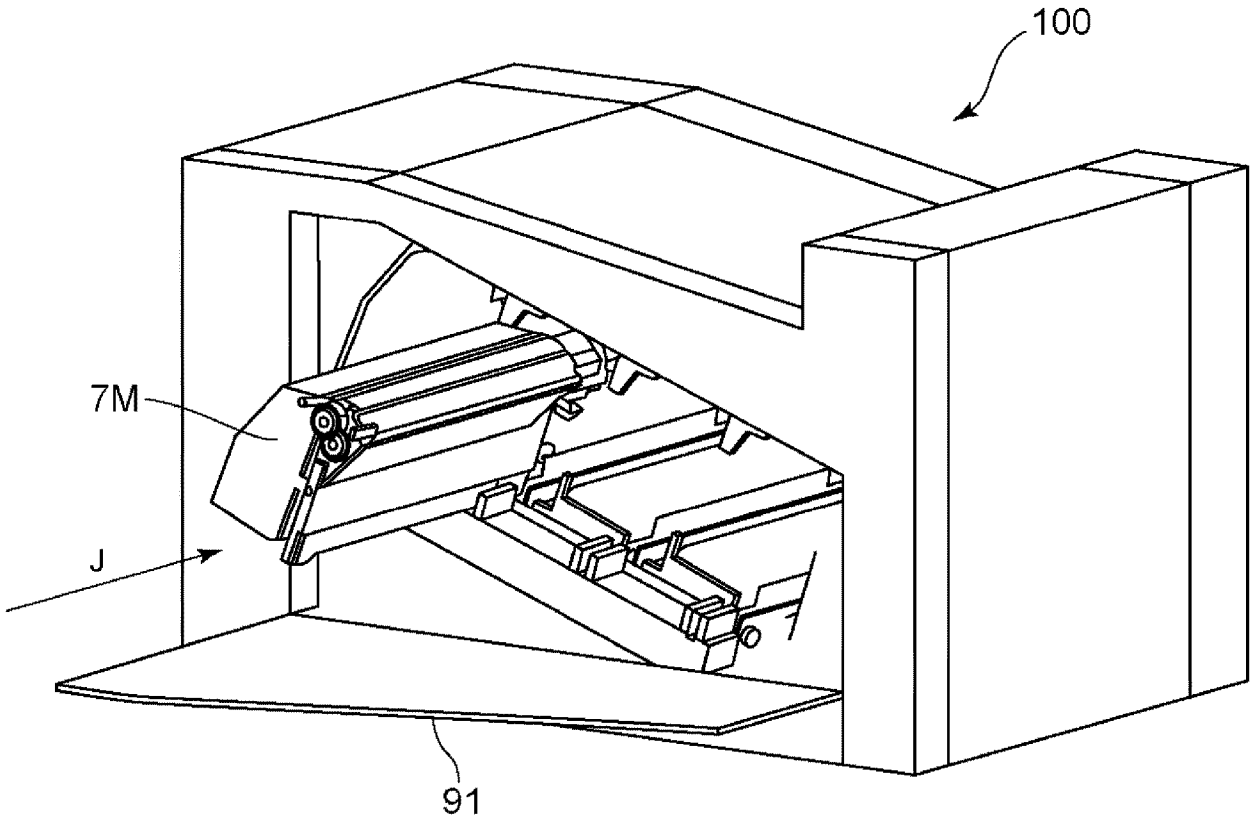
FIG. 6 is a perspective view illustrating the process cartridge in the apparatus main assembly in the embodiment.

The mounting operation of the process cartridge 7 to the image forming apparatus main assembly 100 will be described referring to FIG. 6. FIG. 6 is a perspective view of the main assembly 100 with the front door 91 opened.

The process cartridge 7 is inserted in the direction of the arrow J after opening the front door 91 of the image forming apparatus main assembly 100. After that, it abuts to the rear side plate (not shown) on the rear side of the main unit, by which the insertion is completed. After that, by closing the front door 91 of the main unit 100, the connecting member 32 is connected to the waste toner receiving opening 80*d* (FIG. 5) of the apparatus main assembly 100, and the mounting operation is completed. As will be described in detail here in after, the connecting member 32 connects the discharge path (the second feed path 61) provided in the cartridge 7 to discharge the waste toner to the image forming apparatus main assembly 100.

[Connection of Waste Toner Portion of Cartridge and Main Assembly]

[Configuration of Shutter]

The movement of the shutter (opening/closing member) 34 mounted on the connecting member 32 at the time of mounting will be described referring to FIG. 3 and parts (a) and (b) of FIG. 7. Parts (a) and (b) of FIG. 7 are a front view and a perspective view illustrating the shutter support structure. A connecting member 32, which is the waste toner discharging opening described above, is provided on the rear side (in the direction of the arrow J) of the process cartridge 7 (FIG. 3).

As shown in parts (a) and (b) of FIG. 7, the connecting member 32 is provided with guide portions 32*b*, 32*c* of projection shape projecting in the axial direction. The shutter 34 is provided with grooves 34*a*, 34*b* at respective ends in the cross-sectional direction. The cross-sectional direction is the direction along the crossing portion of the cartridge perpendicular to the axis of the photosensitive drum 1.

The shutter 34 is supported so that the grooves 34*a* and 34*b* are engaged with the projection guide portions 32*b* and 32*c* in a guided state and is movable so as to be movable in the mounting direction (the direction of the arrow J), and seals the waste toner discharge portion 32*d*.

Further, the shutter 34 is provided with an elastic seal member 35 for sealing the waste toner discharge portion 32*d*. The shutter 34 is supported in a state that the elastic seal member 35 is collapsed by a rim of the discharge opening 32*d*. Therefore, as shown in part (a) of FIG. 7, the discharge opening 32*d* of the connecting member 32 is closed without gap by the elastic seal member 35, and the waste toner does not leak.

Further, the shutter 34 is urged toward the rear side in the mounting direction (direction of the arrow J) by the urging member 36 provided in the cleaning frame 14. The discharge opening abutment portion 34*d* of the shutter 34 is brought into contact with the abutment portion 32*e* of the waste toner connecting member 32 by the urging member 36. In this manner, on the process cartridge 7, the shutter 34 is positioned and supported by the connecting member 32.

Further, a shutter guide portion 14*a* that movably supports the shutter 34 in the mounting direction extends in the mounting direction (the direction of the arrow J) at the same position in the cross-sectional direction as the guide portion 32*b* of the connecting member 32 in the cleaning frame 14.

The shutter engaging portions 34*a* and 34*b* of the shutter 34 are partially engaged with and supported by the shutter guide portion 14*a* of the cleaning frame 14 in a state of abutting against the abutment portion 32*e* of the connecting member 32. In other words, the shutter 34 is engaged with both the connecting member 32 and the cleaning frame 14.

As shown in part (b) of FIG. 7, the shutter 34 moves within the process cartridge 7 in the direction opposite to the insertion direction (direction opposite to the arrow J) when the shutter 34 is mounted to the apparatus main assembly 100. In this manner, the shutter 34 is provided so as to be openable and closable with respect to the opening (discharge port) for discharging the waste toner.

By moving the shutter 34 in the direction opposite to the arrow J, the shutter 34 is completely disengaged from the shutter guide portions 32*b*, 32*c* of the connecting member 32. By this, the shutter 34 is engaged and supported only by the guide portion 14*a* of the cleaning frame 14. Therefore, the shutter 34 does not impede the movement of the connecting member 32 in the cross-sectional direction (direction of the arrow N) when the mounting of the shutter 34 to the apparatus main assembly 100 is completed.

The description will be made as to a method of connecting the connecting member 32 and the waste toner receiving opening 80*d* of the apparatus main assembly 100.

(Operation of the Connecting Member for Connecting the Waste Toner Discharging Path and the Apparatus Main Assembly)

The movement of the waste toner connecting member when the front door 91 (see FIG. 6) of the apparatus main assembly 100 is closed will be described referring to parts (a), (b) and (c) of FIG. 8. Parts (a), (b) and (c) of FIG. 8 are schematic views illustrating the operation of the connecting member when opening and closing the front door.

An arm 42 which is rotationally moved by a main assembly front door 91 and a link mechanism (not shown) is provided on the rear side in the mounting direction of the image forming apparatus 100. The connecting member 32 of the process cartridge 7 is provided with the arm abutment portions 32*f* and 32*g* which abut on the arm of the apparatus main assembly 100 in two places projecting in the cross sectional direction (part (a) of FIG. 8). In a state where the process cartridge 7 abuts against the rear side plate 98 of the apparatus main assembly 100, the contact portions 42*a*, 42*b* of the arm 42 are positioned in the upper part of the arm contact portions 32*f*, 32*g* (B)).

Further, when the process cartridge 7 is brought into abutment in the mounting direction, the contact portions 42*a*, 42*b* of the arm 42 overlap the arm contact portions 32*f*, 32*g* of the connecting member 32 by about 4 mm in the mounting direction (direction of arrow J). The arm rotation shaft 42*c* of the arm 42 is rotatably supported by the support holes 98*e*, 98*f* of the rear side plate 98. With the closing operation of the front door of the main assembly 100, the arm 42 is rotated about 42 degrees in the direction of the arrow M around the arm rotating shaft 42*c* by a link mechanism (not shown).

With the rotational motion of the arm 42, the arm 42 abuts to the arm abutting surfaces 32*f*, 32*g* of the connecting member 32. By the rotation operation of the arm 42, the connecting member 32 moves in the direction of the arrow N and reaches the connecting position (the first position, the advancing position) where it is connected to the main assembly toner receiving opening 80*d* side (the direction of the arrow N).

Here, in this embodiment, the connecting member 32 moves by a distance of about 7.7 mm in the direction of the arrow N by the rotation operation of the arm 42.

The connecting member 32 pushed down by the arm 42 in this manner enters the waste toner receiving opening 80*d* of the apparatus main assembly 100 by about 4 mm.

By the above-described operation, the connection member 32 is connected to the waste toner receiving opening 80*d* of the apparatus main assembly 100.

[Drive Connection of Waste Toner Discharging Section]

(Waste Toner Driving Connection Structure)

Referring to parts (a) and (b) of FIG. 9, Drive connection of the waste toner discharging portion with the apparatus main assembly 100 will be described.

Parts (a) and (b) of FIG. 9 are cross-sectional views illustrating a method of connecting the connecting member 32 and the main assembly waste toner receiving opening 80*d*. Part (b) of FIG. 9 is a cross-sectional view of the state in which the connecting member 32 has entered the waste toner receiving opening 80*d* in accordance with the closing operation of the front door (not shown) of the apparatus main assembly 100.

As shown in parts (a) and (b) of FIG. 9, the apparatus main assembly 100 includes a waste toner receiving opening 80*d* for receiving discharged toner from the process cartridge 7.

Here, the waste toner receiving opening 80*d* is provided with a seal member 47. The seal member 47 is an elastic seal member such as a rubber, sponge, urethane foam or the like. When the connecting member 32 of the process cartridge 7 is pushed down, the connecting member 32 enters the main assembly receiving opening sealing member 47 provided in the discharged toner receiving opening 80*d*.

Further, the connecting member 32 has the tapered shape 32*k*, and it is possible to absorb the positional deviation in the axial direction of the connecting member 32 and the waste toner receiving opening 80*d*.

Further, the connecting member 32 is provided with a rib portion 321 (see parts (a), (b) and (c) of FIG. 8) having a flange shape and acts as a lid for closing a gap in the direction of the arrow N when mounted to the waste toner receiving opening 80*d*. As shown in parts (a) and (b) of FIG. 9, the main assembly waste toner feeding portion 80 includes a main assembly first feeding path 80*a* provided with a waste toner receiving opening 80*d*, and a second feeding path 80*b* for feeding waste toner to the waste toner container 14 of the apparatus main assembly 100.

The main assembly first feeding path 80*a* is provided with a spring retainer 43 adjacent to the receiving port. The spring coupling 44 having the elastic force inside the main assembly first feeding path 80*a* is supported by abutting the spring retainer 43 with the spring portion 44*a*. The spring coupling 44 is mounted so as to rotate integrally with the feeding fin 45 as the body side feeding member. The feeding fin 45 has a rotating shaft 45*a*, and the rotating shaft 45*a* is fitted in the fin bearing portion 80*e* of the main assembly feeding member, thereby is rotatably supported thereby. For this reason, the spring coupling 44 is supported rotatably around the center line 61*a*.

By the connecting member 32 entering the waste toner receiving opening 80*d*, the waste toner connecting member moves the spring coupling 44 downward (in the waste toner connecting opening entering direction) against the reaction force of the spring coupling 44 to collapse it.

Further, the spring coupling 44 presses against the second coupling member 30 in the coupling member 32 with an urging force. The second coupling member 30 which abuts is a member that rotates in interrelation with the rotation of the photosensitive drum 1.

By the second coupling member 30 rotating about the axis 61*a*, the spring coupling 44 engages with the second coupling member 30 in the rotational direction and rotates integrally with the feed fin 45.

The second coupling member 30 is a drive output unit (output coupling, cartridge side coupling) for outputting driving force from the cartridge 7 to rotationally drive the spring coupling 44. On the other hand, the spring coupling 44 is a drive input unit (input coupling, image forming apparatus main assembly side coupling) to which driving force is supplied from the cartridge 7.

[Drive Configuration in Cartridge]

(Operation of Waste Toner Carrying Screw)

Drive transmission from the photosensitive drum 1 to the second coupling member 30 will be described. First, the drive transmission path from the photosensitive drum 1 to the waste toner feeding screw 26 will be described referring to FIG. 10.

FIG. 10 is a schematic view of a part showing the driving connection structure from the photosensitive drum 1 to the waste toner second coupling 30.

As shown in FIG. 10, one end of the photosensitive drum 1 is provided with a coupling portion 1*c* driven by the apparatus main assembly 100. The other end has a photosensitive drum gear 1*b* for transmitting the drive to the waste toner feeding screw 26 which will be described hereinafter.

As shown in FIG. 10, an idler gear 52 and a feeding screw gear 53 rotatably supported by the drum bearing 27 (see FIG. 3) are disposed on one end side in the axial direction of the photosensitive drum 1.

The feeding screw gear 53 is engaged with the feeding screw 26 so as to be capable of driving transmission. The rotational driving force is transmitted from the input part of the image forming apparatus 100 to the coupling part 1*c* at one end of the cleaning unit 13. The transmitted rotational driving force is transmitted from the photosensitive drum 1 to the feeding screw 26 via the photosensitive drum gear 1*b*, the idler gear 52, and the feeding screw gear 53. The waste toner accommodated in the waste toner chamber 14*a* is fed in the direction of the arrow H by the feeding screw part 26*a* as the feeding screw 26 rotates in the direction of the arrow G.

In this way, drive transmission from the photosensitive drum 1 to the waste toner screw 26 is performed. The rotational driving force of the waste toner screw 26 is transmitted to the first coupling member 29 disposed at the one longitudinal end of the waste toner screw 26.

(Operation of First Coupling Member)

Next, drive transmission from the waste toner feeding screw 26 to the first coupling member 29 will be described referring to parts (a) and (b) of FIG. 11.

Parts (a) and (b) of FIG. 11 are schematic views of the engagement between the feeding screw 26 and the first coupling member 29 in the process cartridge 7 as viewed from above the center line 61*a* (parts (a) and (b) of FIG. 9).

As shown in parts (a) and (b) of FIG. 11, a plurality of drive pins 29*b* are provided on the first coupling member 29. The feeding screw 26 is provided with a drive transmission blade 26*g*.

When the waste toner screw 26 rotates in the direction of the arrow G, the drive transmission blade 26*g* moves in the direction of the arrow S. The drive transmission blade 26*g* moving in the direction of the arrow S and one (29*b*1) of the plurality of drive pins 29*b* on the first coupling member 29 are engaged with each other and pushed in the direction of the arrow S. by this force, the first coupling member 29 is rotationally driven in the direction of the arrow T about the center line 61*a*.

Here, the drive pin 29*b* is a cylindrical projection shape disposed at regular angular intervals around the axis of the coupling 29. In this embodiment, six drive pins 29*b* having a diameter of 1.8 mm are installed every 60 degrees.

The description will be made as to a phase state in which two drive pins 29*b* (29*b*1, 29*b*2) are present in a range in which it can come in contact with the drive transmission blades 26*g* with respect to the axis of the feed screw 26 (part (a) of FIG. 11).

The drive transmission blade 26*g* rotationally moves the drive pin 29*b*1 in the T direction on the downstream side with respect to the rotational direction T of the drive pin 29*b*. When the drive pin 29*b*1 departs from the drive transmission range of the drive transmission blade 26*g*, the drive transmission pin 29*b*2 on the upstream side in the rotational direction from the drive transmission pin 29*b*1 is brought into contact with the drive transmission blade 26*g* (part (a) of FIG. 11).

By further moving the drive transmission blade 26*g* in the direction of the arrow S, the drive transmission pin 29*b*2 of the first coupling member 29 is moved in the direction of the arrow S (part (b) of FIG. 11).

In this manner, the first coupling member 29 rotates in the direction of the arrow T. By this, the drive pin 29*b* on the upstream side in the rotational direction again moves to the position where it can engage with the drive transmission blade 26*g* (part (a) of FIG. 11).

By repeating the above operation, the first coupling member 29 continues to rotate and move by the rotation of the feeding screw 26.

Here, a line extending in the vertical direction with respect to the axial direction of the feeding screw 26 from the center of the first coupling member 29 is a line X. When two drive pins 29*b* are present at the same angle Y on both sides about the line X, the drive pin 29*b*1 and the drive pin 29*b*2 are positioned farthest from each other in the axial direction of the feed screw 26. The axial distance between the drive pins 29*b*1 and 29*b*2 at this time is Z (see part (a) of FIG. 11).

The pitch of the screws of the drive transmission blades 26*g* is larger than the distance Z between the drive pins 29*b* as viewed in the axial direction of the waste toner screw 26.

Therefore, the drive pin 29*b* can be continuously pressed by the engagement between the drive transmission blade 26*g* and the drive pin 29*b*.

The first coupling member 29 can be rotated more continuously (smoothly) as the pitch (distance Z) of the driving pin 29*b* in the axial direction of the feeding screw 26 and the pitch of the feeding screw 26 are closer. In this manner, the rotational driving of the photosensitive drum 1 is converted into the rotation around the axis of the photosensitive drum 1 (the center line 61*a* of the second feeding path 61) via the waste toner screw 26, and is transmitted to the first coupling member 29.

In this embodiment, the feeding screw 26 is driven by the rotation of the photosensitive drum 1. However, even if the feeding screw 26 is driven in interrelation with the rotation of the developing roller 17, for example, the same effect can be obtained.

(Operation of Second Coupling Member)

Drive transmission from the first coupling member 29 to the second coupling member 30 will be described referring to FIG. 12 and parts (a) and (b) of FIG. 13.

FIG. 12 is an exploded schematic view illustrating the structure of the waste toner discharging unit. Parts (a) and (b) of FIG. 13 is a sectional view illustrating the mounting of the first coupling member 29 and the second coupling member 30 to the coupling receptor 28.

As shown in FIG. 12, the first coupling member 29, the second coupling member 30, the coupling spring 31, the coupling receptor 28, and the connecting member 32 are disposed substantially on the same axis along the center line 61*a* There. The first coupling member 29 and the second coupling member 30 are connected by a coupling spring 31.

The coupling member 32 is movable in the direction of the arrow N in FIG. 12 against the urging force of the coupling spring 31 together with the coupling member 28 and the second coupling member 30. The coupling receptor 28 is a supporting portion which supports the first coupling member 29 and the second coupling member 30 by internally receiving the first coupling member 29 and the second coupling member 30. The connecting portion 32 is also mounted so as to surround the outer periphery of the coupling receptor 28 and is supported by the coupling receptor 28. Therefore, the coupling receptor 28 is also a support for the connecting member 32.

As shown in FIG. 12, the first coupling member 29 is a member including a plurality of projection-shaped drive pins 29*b* which rotate by being engaged with the aforementioned feed screw 26. The first coupling member 29 has two projecting drive claws 29*c* for transmitting the drive to the second coupling member 30.

The driving claw 29*c* of the first coupling member 29 is fitted into the inner diameter portion of the cylindrical portion 28*a* of the coupling receptor 28 and the first coupling member 29 is rotatably supported by the coupling receptor 28. Here, the driving claw 29*c* has a shape in which a part of the cylindrical shape is cut away. In addition, the second coupling member 30 is provided with two driving claws 30*f* which receive rotation drive from the driving claw 29*c* of the first coupling member 29. The second coupling member 30 includes a groove portion 30*b* and a spring hooking groove portion 30*c* in the opposing direction of the driving claw 30*f*.

The driving claw 30*f* also has a shape in which a part of the cylindrical shape is cut away. The outer diameter dimension of the driving claw 30*f* is substantially the same as the driving claw 29*c*. As shown in parts (a) and (b) of FIG. 13, the second coupling member 30 is inserted into the cylindrical portion 28*a* of the coupling receptor 28 so that the driving claw 30*f* faces the driving claw 29*c* of the first coupling member 29.

Here, the drive pawls 29*c* and 30*f* can be expressed as projections in which a part of the cylinder is cut away, and also can be expressed as a bent plate shape including a drive transmission surface. In this embodiment, one side is inclined and the other side is parallel to the rotation axis to form a trapezoidal shape. These shapes are not limited to the shape of this embodiment as long as they are shapes which can permit the phase shift while being able to transmit the driving force.

On the other hand, the coupling spring 31 as the biasing member is a torsion coil spring including a bent shape 31*a* at the tip and a ring shape 31*b* in the opposing direction, as shown in FIG. 12. The coupling spring 31 is inserted into the second coupling member 30 in the direction of the arrow I, and the bent shape 31*a* fits into the spring-hooking groove 30*c*.

Further, in a state of being engaged with the second coupling 30, the circular shape 31*b* of the coupling spring 31 is engaged (fitted) with the groove 29*f* of the first coupling member 29.

At this time, the coupling spring 31 is stretched from the free length. In other words, the coupling spring 31 is brought into a state of giving an urging force in a contracting direction. In this manner, the first coupling member 29 and the second coupling member 30 are urged in a direction to attract each other. The supporting portion 29*d* of the first coupling member 29 abuts against the supporting portion 28*b* of the coupling receiving portion 28 by this urging force.

In the second coupling member 30, the supporting portion 28*c* provided at the tip portion of the cylindrical shape 28*a* of the coupling receiving portion 28 and the projecting portion 30*d* provided on the driving claw 30*f* contact to each other. Then, in the state of receiving the urging force of the coupling spring 31, it is positioned and supported in the rotational direction T of the center line 61*a*.

In a state of being biased by the coupling spring 31, the first coupling member 29 and the second coupling member 30 are rotatably provided via the driving claws 29*c*, 30*f* by the inner periphery of the cylindrical portion 28*a* of the coupling receptor 28 It is supported. The first coupling member 29 and the second coupling member 30 engage with the engaging portion 29*e* and the engaging portion 30*g*, respectively in the direction of the arrow T of the center line 61*a* and can rotate integrally.

With the above structure, drive transmission from the first coupling member 29 to the second coupling member 30 is accomplished.

In the second coupling member 30, the supporting portion 28*c* provided at the tip portion of the cylindrical shape 28*a* of the coupling receiving portion 28 and the projecting portion 30*d* provided on the driving claw 30*f* come into contact. Then, in the state of receiving the urging force of the coupling spring 31, it is positioned and supported in the rotational direction T of the center line 61*a*.

In a state of being urged by the coupling spring 31, the first coupling member 29 and the second coupling member 30 are rotatably supported by the inner periphery of the cylindrical portion 28*a* of the coupling receptor 28 by the way of via the driving claws 29*c*, 30*f* The first coupling member 29 and the second coupling member 30 engage with the engaging portion 29*e* and the engaging portion 30*g*, respectively in the direction of the arrow T of the center line 61*a* and can rotate integrally.

With the above-described structure, drive transmission is effected from the first coupling member 29 to the second coupling member 30.

With the above-described structure, therefore, drive transmission of the waste toner feeding portion from the process cartridge 7 to the apparatus main assembly 100 is accomplished.

Next, a method of assembling the waste toner discharging portion will be described.

(Mounting of Coupling Holder)

As shown in FIG. 12, a first coupling member 29, a second coupling member 30, and a coupling spring 31 are mounted to the coupling receptor 28.

The welded portion 28*e* of the coupling receptor 28 is welded or adhered to the bearing member 27R (FIG. 3) in a state in which the first coupling member 29, the second coupling member 30, and the coupling spring 31 are mounted. By this, the leakage of the waste toner to the outside is reduced.

The coupling member 32 is coaxially fitted into the coupling receptor 28 in the direction of the arrow I.

As shown in FIG. 12, the coupling receptor 28 has a rotation stopping rib 28*d* for positioning the connecting member 32 in the axial rotational direction. The connecting member 32 is provided with a recess rotational positioning groove 32*i* in a part of its circumferential direction.

When the connecting member 32 is fitted in the direction of the arrow I, the rotation stopping rib 28*d* of the coupling receptor 28 is engaged with the groove 32*i* of the connecting member 32. In this manner, the position of the coupling receptor 28 and the connecting member 32 in the rotational direction relative to the axis 61*a* is regulated.

Referring to parts (a) and (b) of FIG. 13, a method of mounting the waste toner connecting portion 32 will be described.

Parts (a) and (b) of FIG. 13 are cross-sectional views illustrating a method of assembling the waste toner discharging section.

On the second coupling member 30, two compression pawls 30*e* are provided in the cylinder opposing direction.

Further, as shown in parts (a) and (b) of FIG. 13, the connecting member 32 is provided with a support portion 32*a* supported by the second coupling member 30 in the axial direction.

When the connecting member 32 is fitted into the coupling receptor 28, the supporting portion 32*a* bends and compresses the compression claw 30*e* of the second coupling member 30 supported by the coupling receptor 28 in the radial direction.

Further, by pushing the connecting member 32, the support portion 32*a* completely overrides the compression claw 30*e* of the second coupling member 30. The coupling member 32 is supported by the support portion 32*a* by the compression claw 30*e* of the second coupling member 30 in the vertical direction (part (b) of FIG. 13).

At this time, it is necessary for the compression claw 30*e* to reliably override the support portion 32*a* in the direction opposite to the arrow I.

For this purpose, when the waste toner connecting portion 32 is mounted to the coupling receptor 28 in the direction of the arrow I, it is necessary for the compression claw 30*e* to override the support portion 32*a* before the upper surface portion (end portion) 32*p* of the waste toner connecting portion 32 and the coupling receptor 28 come into contact with each other. For this reason, the waste toner connecting portion 32 is mounted with the clearance Q to the coupling receptor 28. A seal 501 is mounted in the gap Q to prevent leakage of the waste toner. The seal 501 will be described hereinafter.

[Expansion Mechanism]

An expansion/contraction mechanism for expanding and contracting the toner feeding path (discharge path), and expansion/contraction operation will be described referring to parts (a) and (b) of FIGS. 13 and 14.

Parts (a) and (b) of FIG. 14 are schematic cross-sectional views illustrating a component structure of the waste toner discharging portion.

As described above, the first coupling member 29 and the second coupling member 30 are urged by the coupling spring 31 in the direction of the arrow I (see parts (a) and (b) of FIG. 13).

Therefore, the connecting member 32 can move in the arrow N direction relative to the process cartridge 7 together with the second coupling member 30 (part (a) of FIG. 14 and part (b) of FIG. 14).

The driving claw 29*c* of the first coupling member 29 and the driving claw 30*f* of the second coupling member 30 are supported so as to be able to engage with each other at the inner diameter portion of the cylindrical portion 28 of the coupling receptor 28 in the direction of the rotational arrow T. Therefore, also in the state (part (b) of FIG. 14) in which the second coupling member 30 moves in the direction of the arrow N relative to the first coupling member 29, the engaging portions 29*e* and 30*g* can transmit the driving force in the arrow T direction.

When the cartridge is mounted in the main assembly and is performing the printing operation, the connecting member 32 is in a state in which the second coupling member 30 moves in the direction of the arrow N relative to the first coupling member 29 (in the state of the drive transmission position, part (b) of FIG. 14).

On the other hand, when the process cartridge 7 is in the free state (state that the connecting member 32 is in the retracted position: part (a) of FIG. 14), the first coupling member 29 and the second The coupling members 30 attract each other, by the action of the coupling spring 31 (see parts (a) and (b) of FIG. 13). The connecting member 32 moves in the direction of the arrow I accordingly. As a result, the leading end of the connecting member 32 fits within the outer shape of the process cartridge 7 (outline L in parts (a) and (b) of FIG. 16).

In addition, the first coupling member 29 and the second coupling member 30 of the waste toner discharging portion of the process cartridge 7 rotate either in the main assembly connection state (drive connection position) or the main assembly retracted state (retracted position). Therefore, by engaging the first coupling member 29 and the second coupling member 30, it is possible to inspect the engagement between the first coupling member 29 and the second coupling member 30 by, for example, rotating the photosensitive drum 1 even in an independent state (retracted position) of the process cartridge 7.

Next, a route of delivery of waste toner from the process cartridge 7 to the apparatus main assembly 100 will be described.

(Transportation of Waste Toner During Printing)

The waste toner collected from the photosensitive member 1 as the image bearing member by the cleaning blade 6 is accommodated in a waste toner accommodating portion 14*a* as a storing portion (see FIG. 4). A feeding screw 26 as a feeding member (cartridge side feeding member side) is disposed in the first feeding path 51 of the waste toner accommodating portion 14*a*. By this, the waste toner collected in the waste toner container is fed to the one end side in the longitudinal direction (direction of arrow H) of the process cartridge 7 by the feeding screw 26 as the cartridge side feeding member (FIG. 5).

The carried waste toner is fed to the waste toner receiving opening 80*d* of the apparatus main assembly through a second feeding path 61. The first coupling member 29, the coupling spring 31, the second coupling member 30, and the connecting member 32 are provided in the second feed path 61.

The connecting member 32 is connected to the main assembly waste toner receiving opening 80*d* of the image forming apparatus 100.

The waste toner discharged from the process cartridge 7 is fed from the waste toner receiving opening 80*d* to the second feeding path 80*b* via the spring coupling 44 and the feeding fin 45 as the main assembly side feeding member. After that, it is discharged into the waste toner box 86 (see FIG. 2) as the (main assembly side accommodating portion of the image forming apparatus) by the main assembly carrying screw 85 provided in the second feeding path 80*b* and accommodated therein.

Next, details of the waste toner delivery structure will be described.

(Flow of Waste Toner in the Process Cartridge)

As described above, the waste toner is fed toward the one end in the axial direction of the photosensitive member 1 (direction of arrow H in FIG. 5) by the waste toner screw 26. As shown in FIG. 5, the reverse screw portion 26*e* can also be regarded as the second feeding portion of the feeding screw 26. In other words, the feeding screw 26 has a first feeding portion (feeding screw portion 26*a*) which is a major part for feeding the toner and a second feeding portion (reverse screw) which feeds the toner in the direction opposite to the first feeding section Part 26*e*).

The feeding screw portion 26*a* of the feeding screw 26 is a portion for feeding the toner toward the opening portion 61*b* (part (b) of FIG. 11). On the other hand, the second feeding portion (reverse screw 26*e*) is a portion disposed on the downstream side of the feeding screw portion 26*a* in the toner feeding direction of the feeding screw portion 26*a*. The reverse screw 26*e* as the second feeding part is provided in the neighborhood of the opening part 61*b*, and the length of the reverse screw 26*e* is shorter than that of the first feeding part.

The carried waste toner collides at the position between the feeding screw portion 26*a* and the reverse screw portion 26*e* and is fed from the hole portion 29*a* of the first coupling member 29 to the opening portion 61*b* (arrow U direction).

As shown in parts (a) and (b) of FIG. 11, as the feeding screw 26 rotates, the first coupling member 29 is rotated in the arrow T direction. The waste toner which has passed through the hole portion 29*a* moves to the inner diameter portion of the coupling spring 31 mounted to the first coupling member 29 (parts (a) and (b) of FIG. 9).

As shown in parts (a) and (b) of FIG. 9, the waste toner moves to the hole 30*a* of the second coupling member 30 engaged with the first coupling member 29. At the same time, with the rotation of the first coupling member 29, the drive is transmitted from the engaging portion 29*e* to the engaging portion 30*g* of the second coupling member 30. Therefore, the first coupling member 29, the second coupling member 30 and the coupling spring 31 rotate integrally.

Here, the coupling spring 31 is wound in such a direction as to feed the waste toner in the direction of the arrow N in parts (a) and (b) of FIG. 9 when rotating. Because of this, the waste toner falls freely in the direction of the arrow N and is actively fed in the direction of the arrow N by feeding force. Furthermore, by rotating the coupling spring 31 in the direction of the arrow T, the effect of loosening the waste toner is also produced. For this reason, it is possible to carry out (transfer) the waste toner more smoothly.

The waste toner that has passed through the coupling spring 31 and the hole portion 30*a* of the second coupling member 30 is discharged from the waste toner discharge portion 32*d* of the coupling member 32 supported in the direction of the arrow N to the second coupling member 30. The above is the movement until the discharge of the waste toner in the process cartridge 7.

(Flow of Waste Toner on the Downstream Side of the Waste Toner Discharge Portion)

As shown in parts (a) and (b) of FIG. 9, the waste toner discharged from the waste toner discharging portion 32*d* is discharged from the waste toner receiving opening 80*d* of the image forming apparatus main assembly 100 disposed in the lower part of the waste toner discharging portion 32*d* and enters the second feeding path 80*b* through the first feed path 80*a*.

FIG. 15 is a cross-sectional view of a rear side illustrating a waste toner feeding method in the apparatus main assembly 100.

As shown in FIG. 15, a plurality of waste toner receiving openings 80*d* and first feeding paths 80*a* are provided (80*a* Y, 80*a* M, 80*a* C, and 80*a* K) corresponding to the number of process cartridges 7, and feed the waste toner to the respective feeding paths 80*b*.

The waste toner which has entered the feeding path 80*b* is discharged to the waste toner box 86 by the main assembly feeding screw 85 as a feeding member in the feeding path 80*b*.

Next, the location and assembly of the waste toner feeding structure of the process cartridge 7 will be described in detail.

(Arrangement of Transportation Path and Cross Section)

Referring to parts (a) and (b) of FIGS. 11 and 16, the location of the waste toner feed structure will be described. Parts (a) and (b) of FIG. 16 is a cross-sectional view illustrating the positional relationship between the feeding screw 26 and the discharge opening 32*d* with the center line 61*a* of the second feeding path 61 as the center.

As shown in part (a) of FIG. 16, the center line 61*a* of the second feeding path 61 is disposed to pass between the axis center 26*a* of the first feeding member 26 and the axial center 1*a* of the photosensitive drum 1.

That is, the rotation center 1*a* of the photosensitive drum 1 and the rotation center of the first feeding member 26 are positioned on opposite sides with respect to the center line 61*a*.

The center line 61*a* is substantially the same straight line as the rotation axis of the second coupling member 30. In other words, the rotation center 1*a* of the photosensitive drum 1 and the rotation center of the waste toner feeding screw 26 are on opposite sides with respect to the rotation axis (axis 61*a*) of the second coupling member 30.

By satisfying the above-described positional relationship, the photosensitive drum 1, the waste toner feeding screw 26, and the second feeding path (discharge path) 61 can be disposed in a small space. Therefore, it is possible to reduce or eliminate the projection amount from the outline L (FIG. 3) of the cleaning frame 14. Therefore, it is possible to reduce the size of the cleaning unit or process cartridge as viewed from the axial direction of the photosensitive drum 1.

As shown in part (b) of FIG. 11 and part (a) of FIG. 16, as viewed in the direction of the center line 61*a*, the opening portion 61*b* of the second feeding path 61 overlaps, in range K, a region that the reverse screw portion 26*e* takes when the feeding screw 26 rotates the opening 61*b* is a fluid communicating portion where first feeding path 51 and second feeding path 61 communicate.

By this, the waste toner can be smoothly fed from the first feeding path 51 to the second feeding path 61 by the feeding force of the feeding screw 26. As shown in part (a) of FIG. 16, the first feeding path 51 and the second feeding path 61 overlap in the longitudinal direction of the cartridge (the left-right direction in the drawing). As a result, it is possible to reduce the width of the cleaning unit 13 in the longitudinal direction while ensuring the diameter of the feeding path necessary for feeding the waste toner. As a result, it is possible to downsize the process cartridge 7.

(Sealing Structure of Connecting Portion)

Figure 1:
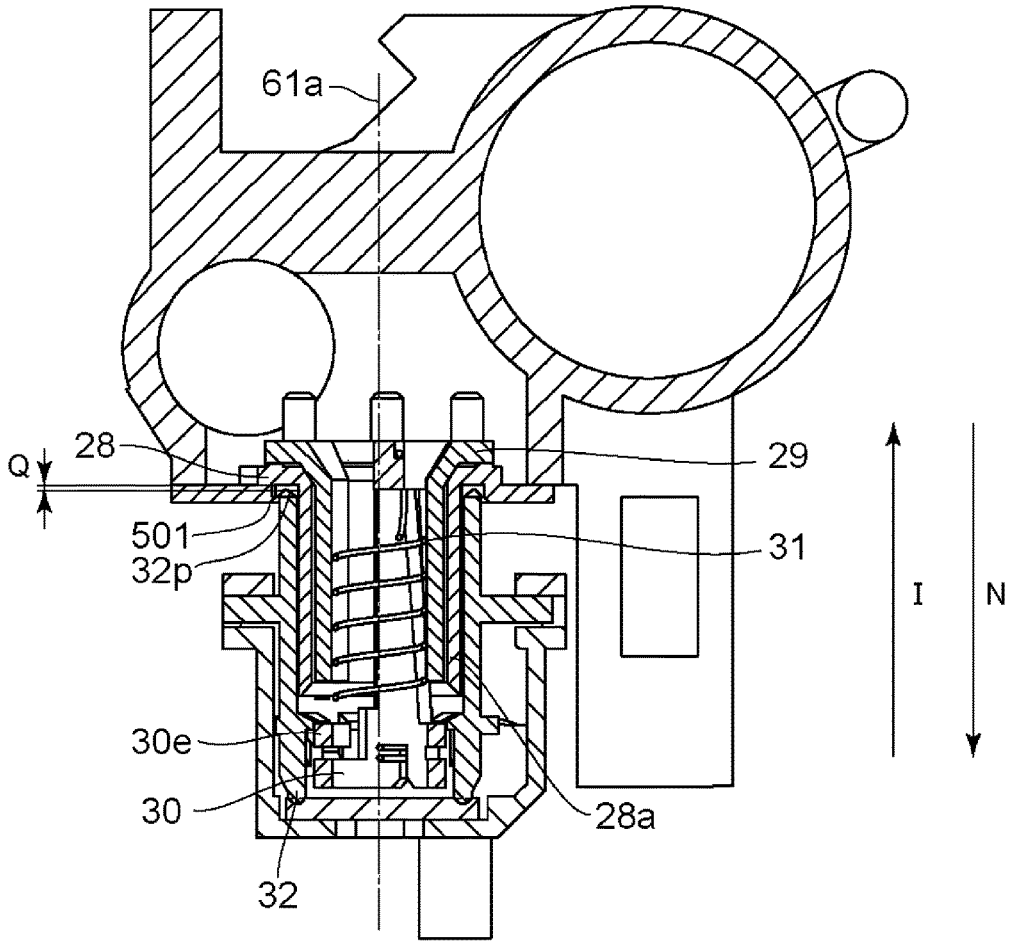
FIG. 1 is a cross-sectional view illustrating a position of a seal used in this embodiment.

FIG. 1 is a sectional view illustrating an installation portion of a seal described in this embodiment. FIG. 17 is a cross-sectional view illustrating a gap of the waste toner feed path in a state not connected to the apparatus main assembly.

As shown in FIG. 1, a waste toner connecting portion 32 is coaxially provided (61*a*) on the cylindrical portion 28*a* of the coupling receptor 28. The waste toner connecting portion 32 is disposed so as to fit into the cylindrical portion 28*a* of the coupling receptor 28 with a clearance. Further, the waste toner connecting portion 32 is provided on the coupling receptor 28 so as to be movable in the direction of the arrow N.

As described above, the waste toner connecting portion 32 is disposed with the gap Q relative to the coupling receptor 28. In the gap Q, a seal 501 including elasticity is mounting. The seal 501 is a member (sealing portion, sealing member) for suppressing leakage of toner to the outside of the cartridge by sealing the discharge passage of the toner. Examples of the material of the seal 501 include foamed polypropylene and foamed urethane foam.

The seal 501 has elasticity. As described above, when the waste toner connecting portion 32 is assembled, the waste toner connecting portion 32 is compressed in the direction of the arrow I by mounting it in the direction of the arrow I. At this time, the seal 501 provided in the gap Q is compressed to the upper surface portion 32*p* of the connecting member 32, so that it is possible to close the gap Q without the influence to the easiness of assembly. The upper surface portion 32*p* is an end portion provided on the upstream side of the connecting member 32 in the moving direction (the direction of the arrow N) of the toner discharged from the discharge opening 32*d*. In this embodiment, the toner moving direction N is substantially the same as the moving direction of the connecting member 32 when moving to this the advancing position (connecting position: part (b) of FIG. 16). Conversely, the toner moving direction N is substantially opposite to the moving direction I of the connecting member 32 which moves toward the retracted position (part (a) of FIG. 16).

Next, referring to parts (a), (b) and (c) of FIG. 18 and FIG. 19, a method of mounting the seal 501 will be described.

Parts (a), (b) and (c) of FIG. 18 is an external perspective view illustrating a method of mounting the seal 501 on the coupling receptor 28. FIG. 19 is an external view of the seal 501.

As shown in parts (a), (b) and (c) of FIG. 18, a seal mounting groove 28*h* having an a recess shape with respect to the surface 28*g* is disposed on the outer periphery of the cylindrical portion 28*a* in the coupling receptor 28. In addition, a groove portion 28*j* for locking the seal 501 and a recessed hole portion 28*k* are provided in the coupling receptor.

As shown in parts (a), (b) and (c) of FIG. 18, the seal 501 has a cylindrical shape including a hole shape 501*a* fitted in the cylindrical portion 28*a* of the coupling receptor 28. In the part on a hole diameter, a recess 501*b* is provided at a position where it fits into the projection shaped rotation stopping rib 28*d* of the coupling receptor 28. In addition, the seal 501 is provided with a projection shape 501*c* for positioning relative to the coupling receptor 28 in the rotational direction of the cylindrical shape 501*a* (FIG. 19). The projection shape 501*c* has a projecting shape including a thick portion 501*e*. And, it has a thin portion 501*d* at its root.

As shown in part (a) of FIG. 18, the seal 501 is mounted to the coupling receptor 28 in the direction of the arrow I. At the same time that the hole shape 501*a* of the seal 501 is fitted in the cylindrical portion 28*a* of the coupling receptor 28, the recess 501*b* of the seal 501 is fitted into the rotation stopping rib 28*d*. By this, the seal 501 inserted into the surface 28*g* reaches the surface 28*g* (part (b) of FIG. 18) while the position in the rotational direction can be determined with a cylindrical shape. When the seal 501 is further compressed, the cylindrical seal 501 enters the seal mounting groove 28*h*. Here, the outer diameter 501*f* of the seal 501 is slightly larger than the outer diameter of the seal mounting groove 28*h*. Due to the elasticity of the seal 501, it is compressed against the coupling receptor 28 by the difference in the outer diameter. Furthermore, by fitting the projection thick portion 501*c* of the seal 501 into the recess groove portion 28*j*, the thin portion 501*d* of the seal is pressed into the seal mounting groove 28*j* in a press fitted state.

In this manner, due to the force for press-fitting the detailed portion 501*d* into the seal mounting groove 28*j* and the holding force due to the elasticity of the seal 501 in the seal mounting groove 28*h*, the seal 501 does not disengage in the arrow N direction from the coupling receptor 28.

Further, in this embodiment, the mounting of the seal receiver to the coupling receptor 28 is carried out using the elasticity of the seal. In other words, the seal 501 is pressed into the recess (seal mounting groove 28*h*) provided in the coupling receptor 28 while being compressed, and the seal member 501 is fixed into the recess (depression). The seal 501 is press-fitted into the recess (seal mounting groove 28*h*) of the coupling receptor 28. However, the structure for fixing the seal (sealing part) is not limited to this kind. For example, the seal 501 may be adhered (mounted) to the installation surface side of the coupling receptor 28 using an adhesive, an adhesive, or the like. Alternatively, such adhesion and press fitting may be used simultaneously.

Next, referring to parts (a), (b) and (c) of FIG. 20, the description will be made as to the movement when the cartridge is mounted on the apparatus main assembly in a state where the seal 501 is mounting in the coupling receptor 28.

part (a) of FIG. 20 is a sectional view of only the process cartridge when the process cartridge 7 is set in the apparatus main assembly 100. Part (b) of FIG. 20 is a cross-sectional view when the apparatus main assembly 100 and the cartridge 7 are connected with each other. Part (c) of FIG. 20 is a cross-sectional view when the connection is released again from the connected state.

As described above, when the process cartridge 7 is mounted on the apparatus main assembly 100, the waste toner connecting portion 32 is placed in a position where it can come into contact with the arm 42 (part (b) of FIG. 8) of the apparatus main assembly 100.

Further, by closing the front door 91 (FIG. 6) of the apparatus main assembly 100, the waste toner connecting portion 32 is moved in the direction of the arrow N (part (c) of FIG. 8 and part (b) of FIG. 20).

At this time, the seal 501 is held by the coupling receptor 28 in a state of being press-fitted and engaged with the coupling receptor 28. When the front door 91 of the apparatus main assembly 100 is opened again, the waste toner discharging portion 32 is moved in the direction of the arrow I by the urging force (pulling force) of the tension spring 31 mounted therein (see part (b) of FIG. 20).

The upper surface 32*p* of the waste toner connecting portion 32 is compressed in the direction of the arrow I by the urging force (pulling force) of the tension spring 31.

In this manner, the waste toner connecting part 32 moves to the position shown in part (a) of FIG. 20, and the connection with the apparatus main assembly 100 is released (part (c) of FIG. 20).

Here, as shown in FIG. 17, the gap Q is slight. Therefore, even if the seal 501 is not provided, leakage of waste toner can be suppressed by fitting the connecting member 32 into the cylindrical portion 28*a* of the coupling receptor 28. However, if the cartridge 7 vibrates or tilts during transportation after use of the process cartridge, for example, the toner may leak through the above-described gap Q in the direction of the arrow R (Depending on the state of toner in the toner discharge path). In this embodiment, however, by the provision of the seal 501, the leakage of toner in the waste toner discharge path can be suppressed even when vibration or tilting occurs.

When toner is present in the waste toner feed path (second feed path 61) during the movement shown in parts (a), (b) and (c) of FIG. 20, there is a risk of waste toner spouting slightly from clearance Q, when the position of the waste toner connecting portion 32 changes from the position of part (b) of FIG. 20 to the position of part (c) of FIG. 20. Even at this time, the seal 501 makes it possible to suppress such toner outflow.

The structure of the cartridge of this embodiment described above can be summarized as follows.

A discharge path (second feeding path 61) for discharging the toner has a movable portion (a connecting member 32). In such a structure, a space (gap Q) is formed around the movable part, so that there is a possibility that this space forms a path for communicating the inside and the outside of the discharge path in addition to the discharge opening 32*d*. In order to prevent toner from flowing out from such a path (space), the sealing portion (seal 501) is brought into contact with the movable portion (connecting member 32). By this, the discharge path is more reliably sealed.

More specifically, the cartridge 7 has a second feeding path 61 (FIG. 5) as a discharge path for feeding the toner removed from the photosensitive drum 1. There is a space inside the coupling receptor 28, the coupling 29 and the connecting portion 32 (FIG. 12, part (a) of FIG. 9, part (b) of FIG. 9), this space is the second feeding path 61 (FIG. 5).

That is, the toner is moved in the internal space of the coupling receptor 28, the coupling 29, and the connecting member 32, and finally discharged to the outside of the cartridge through the discharge opening 32*d* provided at the end of the second feed path 61 (FIG. 5, part (a) of FIG. 9, part (b) thereof). The outlet 32*d* is provided in the connecting member 32. Both the coupling receptor 28 and the connecting member 32 exposed to the outside of the cartridge have a hollow cylindrical shape (pipe shape, pipe shape). In other words, the discharge path has a double cylinder structure. The cylindrical portion 28*a* (FIG. 17) of the coupling receptor 28 is an inner cylinder provided inside the connecting member 32. On the other hand, the connecting member 32 is an outer cylinder provided outside the cylindrical portion 28*a* of the coupling receptor 28. In other words, the connecting member 32 is provided so as to surround the outer periphery of the coupling receptor 28.

As the connecting member 32 moves, the second feeding path 61 expands and contracts. In other words, the connecting member 32 is a movable part movable relative to the coupling receptor 28 and the like, and moves between the retracted position (part (a) of FIG. 9) and the advanced position (connecting position: part (b) of FIG. 9) obtain. In other words, the connecting member 32 can move back and forth along the cylindrical portion 28*a* of the coupling receptor 28.

The connecting member 32 retracts to the upstream side in the moving direction of the discharged toner (direction of arrow N), so that the connecting member 32 reaches the retracted position (part (a) of FIG. 9). When the cartridge is mounted to or dismounted from the main assembly of the image forming apparatus, the connecting member 32 does not obstruct mounting and dismounting of the cartridge (part (a) of FIG. 8), because the connecting member 32 is located at the retracted position. In addition, when the cartridge is not used, the size of the cartridge can be kept small by positioning the connecting member 32 at the retracted position or the like.

As shown in part (b) of FIG. 9, the connecting member 32 advances toward the downstream side in the toner moving direction (direction of arrow N), whereby the connecting member 32 reaches the advanced position (connecting position). When the cartridge 7 is mounted on the image forming apparatus main assembly and moved to the advance position, the discharge path of the cartridge is connected to the receiving opening 80*d* of the image forming apparatus main assembly. In other words, the connecting member 32 is a connecting portion that connects the second feeding path 61 of the cartridge and the receiving opening 80*d* of the image forming apparatus main assembly to each other. In this connected state, the toner passes through the discharge opening 32*d* of the discharge path and is discharged to the receiving opening 80*d* outside the cartridge.

Further, the connecting member 32 slides linearly along the coupling receptor 28 (part (a) of FIG. 14 and part (b) of FIG. 14). The coupling receptor 28 is a supporting portion that movably supports the connecting member 32, and is also a guide portion which guides the moving direction of the connecting portion 32. The outer periphery of the coupling receptor 28 guides the inner periphery of the coupling member 32. A small gap (space) may be produced between the outer periphery of the coupling receptor 28 and the inner periphery of the coupling member 32 in order to smoothly move the connecting member 32.

As described above, the internal space of the coupling receptor 28 forms at least a part of the discharge passage. In other words, the cartridge receiver 28 can be regarded as a part of the discharge path. The coupling receptor 28 is fixed to the frame of the cartridge and can be regarded as part of the frame of the cartridge. The coupling member 32 is a movable portion of the discharge passage, whereas the coupling receptor 28 is a fixed portion (immovable portion) of the discharge passage. In other words, the coupling receptor 28 is fixed relative to the cartridge 7 and does not move.

The second coupling member 30 advances and retracts in interrelation with advancement and withdrawal of the coupling member 32. When advancing, the second coupling member 30 becomes connectable with the spring coupling 44 provided in the image forming apparatus main assembly. In other words, the second coupling member 30 is in a state that the driving force can be transmitted to the spring coupling 44 and the feeding fin 45 (a state that it is positioned at the drive transmission position (advanced position)). In other words, since the movable mechanism is replaced with a new one at the timing when the cartridge 7 is exchanged, the possibility that the same movable mechanism is used for an excessively long period is low, and the operational stability of the movable member can be easily maintained.

Further, to the toner feeding member (the spring coupling 44 and the feeding fin 45, FIG. 5, part (a) of FIG. 9, part (b) thereof) provided inside the receiving opening 80*d* of the image forming apparatus main assembly, the driving force is transmitted from the second coupling member 30 provided in the first coupling member 61. Since the driving force is transmitted to the spring coupling 44 and the feeding fin 45 inside the toner feeding path, the structure for transmitting the driving force is simplified. if unlike this embodiment, it is attempted to input the driving force from the outside of the toner feeding path to the spring coupling 44 and the feeding fin 45, a part of the drive transmission mechanism has to pass through the inside and the outside of the toner feeding path. In such a case, it is necessary to prevent toner from leaking around the penetrating part of the feeding path and so on, with the result that the structure of the image forming apparatus may be more complicated than in this embodiment.

If the second coupling member 30 and the spring coupling 44 are disposed in the toner feeding path, the toner may be interposed between the meshing portions of the second coupling member 30 and the spring coupling 44. However, in this embodiment, the second coupling member 30 and the spring coupling 44 are disposed along the same axis. therefore, they rotate integrally when they are coupled, and for this reason, these couplings are less susceptible to toner. Unlike this embodiment, in the case of a structure in which the driving force is transmitted to the feeding fin 45 by engagement of two gears instead of coupling (coupling) of the two coupling members, a possibility of influence such as wearing of teeth arises. In other words, the two gears rotate to transmit driving force while different teeth engage one after another. Therefore, if toner is interposed between the gear teeth, friction occurs between the toner and the teeth as the engagement of these gear teeth changes, and there is a possibility that the toner causes abrasion of the teeth. On the other hand, if the coupling structure of this embodiment is employed, the second coupling member 30 and the spring coupling 44 integrally rotate around substantially the same axis. Therefore, the engagement of the two couplings does not change easily. for this reason a, even if toner is interposed between the two couplings, both couplings are less susceptible to wear and the like.

According to the structure of this embodiment, when the cartridge 7 is not mounted to the main assembly of the image forming apparatus, the driving force is not transmitted to the spring coupling 44 and the feeding fin 45, and these do not rotate. Even if the power (motor) of the image forming apparatus main unit is applied when the cartridge 7 is not mounted, the spring coupling 44 and the feeding fin 45 do not rotate. Therefore, problems such as these scattering the toner inside the toner receiving opening 80 can be suppressed.

The cartridge has a shutter 34 (part (a) of FIG. 7 and part (b) of FIG. 7). The shutter 34 is an opening/closing member for opening and closing the discharge opening 32*d*. In a state in which the cartridge is completely loaded in the image forming apparatus main assembly, the shutter opens the discharge opening 32*d* (part (b) of FIG. 9). This allows the toner to be discharged from the discharge opening 32*d* to the outside of the cartridge, that is, toward the image forming apparatus main assembly (part (b) of FIG. 9). On the other hand, when the cartridge is not mounted to the main assembly of the image forming apparatus, the shutter 34 closes the discharge opening 32*d* of the connecting part 32 and the opening of the second carrying path (part (a) of FIG. 7). This prevents toner from leaking through the discharge opening 32*d* and the second feed path 61. Part (a) of FIG. 7 shows a state in which the shutter 34 closes the discharge opening of the second feed path 61 (that is, the discharge opening 32*d* of the connecting member 32). When the cartridge is dismounted from the main assembly of the image forming apparatus, leakage of toner to the outside of the cartridge is suppressed by the shutter 34 in this manner.

However, even in this state, gaps (gaps, spaces) where the toner can leak out of the discharge opening 32*d* may occur around the movable portion (the connecting member 32) of the discharge path. In other words, there is a small space between the frame of the cartridge (the coupling receptor 28) and the connecting member 32. Particularly, the space (gap Q) around (near) the upper surface portion 32*p* of the discharge opening 32*d* leads to the outside of the cartridge (FIG. 17).

In the moving direction of the toner (direction of arrow N), the gap Q is located upstream of the discharge opening 32*d*. Therefore, toner does not leak through the clearance Q during a normal handling of the cartridge. However, if the cartridge is shaken after it is removed from the main assembly of the image forming apparatus, the toner inside the discharge path may move through the path indicated by the arrow R through the gap between the connecting member 32 and the cartridge receiver 28. In this case, the toner may eventually leak out through the gap Q (FIG. 17).

Alternatively, after the cartridge 7 is dismounted from the image forming apparatus main assembly, the cartridge may take attitude in which the discharge path (second feed path 61) is disposed below. In such a case, the toner remaining in the first feeding path 51 and the waste toner accommodating chamber 14*a* (FIG. 5) flows into the second feeding path 61 by gravity, with the result that the toner reversely flows and passes through the path of the arrow R to overflow to the outside through the gap Q.

Alternatively, in a state in which the cartridge is mounted inside the main assembly of the addition forming device, the connecting member 32 moves from the advance position (drive transmission position) to the retracted position in the direction of the arrow I (part (a) of FIG. 16 and part (b) of FIG. 16). In the course of this movement, the toner interposed between the coupling member 32 and the coupling receptor 28 may leak out of the cartridge.

Therefore, in this embodiment, the seal 501 is provided on the upstream side of the discharge opening 32*d* in the toner movement direction N. More specifically, the seal 501 is disposed upstream of the upper surface 32*p* of the connecting member 32.

As a result, when the connecting member 32 is in the retracted position, the seal 501 contacts the upper surface portion 32*p* of the connecting member 32. When the cartridge is dismounted from the main assembly of the image forming apparatus, the gap Q is sealed with the seal 501 to more assuredly suppress the leakage of the toner. In other words, it is suppressed by the seal 501 that the path through which the toner flows out from the discharge path is produced in a portion other than the discharge opening 32*d*. The seal 501 is a sealing portion which contacts the connecting member 32 at a position different from the discharge opening 32*d* and seals the discharge path at a position different from the discharge opening 32*d*. In other words, the seal 501 is a sealing portion which seals the discharge passage at a position different from that of the shutter 34.

The seal 501 may have any shape as long as it seals the gap Q formed around (near) the upper surface portion 32*p* of the connecting portion 32. In this embodiment, the connecting portion 32 has a tubular shape (pipe shape, pipe shape), and the cross portion of the pipe (pipe, pipe) is a circle. Therefore, the seal 501 has a ring shape corresponding to the shape of the connecting member 32 (that is, a shape forming an opening in the inside), and the seal 501 has a circular opening (part (a) of FIG. 18). In other words, in order to enhance the sealing effect of the toner by the seal 501, the seal 501 is in contact with the entire periphery of the upstream side end portion of the connecting member 32. In other words, the seal 501 contacts the entire edge of the cylinder forming the connecting member 32.

The seal 501 is provided so as to cover the outer circumference of the frame (the cylindrical portion 28*a* of the cartridge receiver 28) of the cartridge constituting the second feeding path 61. In other words, the cylindrical portion 28*a* passes through the opening of the seal 501 (part (a) of FIG. 18, part (b) thereof and part (c) thereof).

If the cross-sectional shape of the connecting member 32 and the cartridge receiver 28 is not a circle but a square, the seal 501 may be formed into a ring shape including a rectangular opening correspondingly. This also applies to cases where the shapes of the connecting member 32 and the cartridge receiver 28 are other than square. The shape of the opening of the seal 501 may be changed according to the shape of the discharge path (the shape of the coupling portion 32 and the cartridge receiver 28). In other words, although the seal 501 is described as a ring shape forming a circular opening in this embodiment, the seal 501 can have various shapes depending on the structure of the cartridge.

The seal 501 has elasticity. When the connecting member 32 is positioned at the retracted position, the seal 501 is compressed between the coupling member 32 and the coupling receptor 28. As a result, the seal 501 is in close contact with the coupling member 32 and the coupling receptor 28, thereby reliably closing the gap where toner may leak. On the other hand, when the connecting member 32 moves to the advanced position, the seal 501 separates from the upper surface portion 32*p* of the connecting member 32, and the above compression is at least partly eliminated.

The seal 501 is not limited to the structure fixed to the coupling receptor 28. For example, as shown in part (a) of FIG. 21, part (b) thereof, and part (c) thereof, the seal 1501 may be fixed to the upper surface portion 32*p* of the connecting member 32. Part (a) of FIG. 21 is a sectional view of only the process cartridge when the process cartridge 7 is installed in the apparatus main assembly 100. Part (b) of FIG. 21 is a cross-sectional view when the apparatus main assembly 100 and the cartridge 7 are connected. Part (c1) of FIG. 21 is a cross-sectional view when the connection is released again from the connected state. In this case as well, the seal 1501 can be regarded as being located upstream of the connecting member 32 in the toner moving direction, similarly to the above structure. However, unlike the structure described above, the seal is constantly in contact with the upper surface portion 32*p*.

When the connecting member 32 is in the retracted position, such a seal 1501 is pressed against the coupling receptor 28 by the connecting member 32 to close the gap Q.

Alternatively, as shown in part (a) of FIG. 22, part (b) of FIG. 22 and part (c) of FIG. 22, a seal 2501 may be movably provided on the coupling receptor 28. Part (a) of FIG. 22 is a sectional view of only the process cartridge when the process cartridge 7 is mounted in the apparatus main assembly 100. Part (b) of FIG. 22 is a cross-sectional view when the apparatus main assembly 100 and the cartridge 7 are connected. Part (c) of FIG. 22 is a cross sectional view when the connection is released again from the connected state.

As shown in part (a) of FIG. 22, part (b) thereof and part (c) thereof, the seal 2501 is supported by the coupling receptor 28, but unlike the seal 501, it is not fixed to the coupling receptor 28. In other words, the seal 2501 is movably supported by the coupling receptor 28.

Even with such a structure, if the connecting member 32 is in contact with the seal 2501 when it is in the retracted position, the same sealing effect as in this embodiment can be obtained by sealing the gap.

That is, even if the seal 2501 is movable between the coupling receptor 28 and the coupling member 32, the seal 2501 is pushed by the coupling member 32 in the process of the movement of the coupling member 32 toward the retracted position to be pressed against the receiver 28. As a result, when the connecting member 32 moves to the retracted position, the seal 2501 is sandwiched between the coupling member 32 and the coupling receptor 28, so that the seal 2501 can close the gap.

The seal 1501 and the seal 2501 shown in parts (a), (b) and (c) of FIGS. 21 and 22 move in interrelation with the movement of the connecting member 32. Therefore, there is a possibility that friction may occur between the seals (2501, 1501) and the coupling receptor 28 at this time. In addition, also in part (a) of FIG. 23, the seal 501 is disposed so as to surround 360° around the discharge path (second feed path 61). In other words, the seal 501 can be regarded as being in contact with the entire circumference of the connecting member 32.

Further, as shown in part (b) of FIG. 23, the seal 1501 can be fixed to the upper surface portion 32*q*. Even in this case, the seal 1501 is provided so as to surround 360° around the discharge path (the second feed path 61). In other words, the seal 1501 can be regarded as being in contact with the entire circumference of the connecting member 32. In part (b) of FIG. 23, the seal 1501 is distant from the cylindrical portion 28*a* of the coupling receptor 28. However, even in this case, the seal 1501 can be regarded as blocking the flow path of the toner generated between the connecting member 32 and the cylindrical portion 28*a* of the coupling receptor 28.

In this embodiment, the photosensitive drum 1, the developing roller 17, the charging roller 16, and the like are provided in one cartridge, but the present invention is not limited to such a structure. For example, it is possible to employ a structure in which the cartridge 7 has the seal 501, the discharge path (the second feed path 61), the connecting member 32, and the like, but does not have the developing roller 17. As an example of such a structure, there is a cleaning unit 13 and a developing unit which are not connected to each other, and the cleaning unit 13 constitutes a cartridge as a single unit.

In this embodiment, in order to remove toner from the photosensitive drum 1, a plate-like (blade-like) cleaning blade 6 is in contact with the photosensitive drum 1 on the photosensitive drum 1. However, in place of the cleaning blade 6, a brush-like cleaning member or the like may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-107458 filed on May 31, 2017, which is hereby incorporated by reference herein in its entirety.

What is claimed is:

1. A cartridge comprising:

a photosensitive member;

a discharging path configured to permit movement of developer removed from the photosensitive member, the discharging path including a developer discharge opening and a movable portion through which the developer is movable, the movable portion being movable between (i) a retracted position on an upstream side with respect to a developer moving direction through the discharge opening and (ii) an advanced position on a downstream side with respect to the developer moving direction; and a sealing portion configured to close the discharging path by contacting the movable portion at a position different from the position of the discharge opening.

2. A cartridge according to claim 1, wherein the sealing portion is disposed upstream of the discharge opening with respect to the developer moving direction when the movable portion is in the retracted position.

3. A cartridge according to claim 1, wherein the sealing portion is disposed upstream of the movable portion with respect to the developer moving direction when the movable portion is in the retracted position.

4. A cartridge according to claim 1, further comprising an openable member capable of opening and closing the discharge opening.

5. A cartridge according to claim 4, wherein the sealing portion is disposed upstream of the openable member with respect to the developer moving direction when the openable member closes the discharge opening.

6. A cartridge according to claim 4, wherein the openable member closes the discharge opening when the movable portion is in the retracted position, and the movable portion is permitted to move from the retracted position to the advanced position by the openable member opening the discharge opening.

7. A cartridge according to claim 1, wherein the sealing portion is sandwiched between the movable portion and a fixed portion fixed to cartridge when the movable portion is in the retracted position.

8. A cartridge according to claim 1, further comprising a frame provided with a supporting portion movably supporting the movable portion, wherein the sealing portion is sandwiched between the frame and the movable portion when the movable portion is in the retracted position.

9. A cartridge according to claim 8, wherein the supporting portion constitutes a part of the discharging path, and the developer is movable inside of the supporting portion.

10. A cartridge according to claim 8, wherein the sealing portion is mounted to the frame.

11. A cartridge according to claim 10, wherein the sealing portion is press-fitted in a recess provided in the frame.

12. A cartridge according to claim 10, wherein the sealing portion is bonded to the frame.

13. A cartridge according to claim 1, when the sealing portion is mounted to the movable portion and is movable together with the movable portion.

14. A cartridge according to claim 1, wherein the sealing portion is provided with an engaging portion to fix the sealing portion to the cartridge.

15. A cartridge according to claim 1, wherein the movable portion has a cylindrical configuration.

16. A cartridge according to claim 15, wherein the sealing portion contacts an edge of the cylindrical configuration.

17. A cartridge according to claim 1, wherein the sealing portion contacts substantially an entirety of a circumference of the movable portion.

18. A cartridge according to claim 1, wherein the sealing portion has a ring configuration.

19. A cartridge according to claim 1, further comprising a feeding member rotatable to feed the developer toward the discharging path.

20. A cartridge according to claim 1, wherein the discharging path is provided with a drive outputting portion configured to output a driving force to outside of the cartridge.

21. A cartridge according to claim 1, wherein the sealing portion is elastic.

22. A cartridge according to claim 1, wherein the sealing portion is compressed by the movable portion moving from the advanced position to the retracted position.

23. An image forming apparatus comprising:

a cartridge according to claim 1; and a main assembly including a receiving opening configured to receive the developer from the discharge opening of the cartridge, wherein, when the cartridge is mounted to the main assembly and the movable portion is in the advanced position, the discharging path is connected to the receiving opening.

24. A cartridge comprising:

a photosensitive member;

a feeding path configured to permit movement of developer removed from the photosensitive member, the feeding path including a hollow inner cylinder and a hollow outer cylinder surrounding an outer periphery of the inner cylinder, the hollow outer cylinder being reciprocal along the inner cylinder between a retracted position and an advanced position; and a sealing portion for closing a developer flow path formed between the inner cylinder and the outer cylinder.

25. A cartridge according to claim 24, wherein the outer cylinder is provided with a discharge opening configured to discharge developer to outside of the cartridge.

26. A cartridge according to claim 25, further comprising an openable member configured to open and close the discharge opening.

27. A cartridge according to claim 26, wherein the sealing portion is disposed upstream of the openable member with respect to a developer moving direction when the openable member closes the discharge opening.

28. A cartridge according to claim 26, wherein the openable member closes the discharge opening when the outer cylinder is in the retracted position, and the outer cylinder is permitted to move toward the advanced position by the openable member opening the discharge opening.

29. A cartridge according to claim 25, wherein the sealing portion disposed upstream of the discharge opening with respect to the developer moving direction inside of the outer cylinder when the outer cylinder is in the retracted position.

30. A cartridge according to claim 24, wherein, when the outer cylinder is in the retracted position, the sealing portion is disposed upstream of the outer cylinder with respect to a developer moving direction inside of the outer cylinder so as to be in contact with the outer cylinder.

31. A cartridge according to claim 24, wherein the sealing portion surrounds a circumference of the inner cylinder.

32. A cartridge according to claim 24, wherein the sealing portion is press-fitted in a recess.

33. A cartridge according to claim 24, wherein the sealing portion is fixed to the cartridge by bonding.

34. A cartridge according to claim 24, wherein the sealing portion is mounted to the outer cylinder so as to be movable together with the outer cylinder.

35. A cartridge according to claim 24, wherein the sealing portion is provided with an engaging portion to fix the sealing portion to the cartridge.

36. A cartridge according to claim 24, wherein the sealing portion contacts an edge of the outer cylinder.

37. A cartridge according to claim 36, wherein the sealing portion contacts substantially an entirety of the edge of the outer cylinder.

38. A cartridge according to claim 24, wherein the sealing portion has a ring configuration.

39. A cartridge according to claim 24, further comprising a feeding member rotatable to feed the developer.

40. A cartridge according to claim 24, wherein the discharging feeding path is provided with a drive outputting portion configured to output a driving force to outside of the cartridge.

41. A cartridge according to claim 24, wherein the sealing portion is elastic.

42. A cartridge according to claim 24, wherein the sealing portion is compressed by the outer cylinder moving toward the retracted position.

43. A image forming apparatus comprising:

a cartridge according to claim 24;

and a main assembly.

* * * * *